US006109485A

United States Patent [19]

Amidzich

[11] Patent Number: 6,109,485

[45] **Date of Patent: *Aug. 29, 2000**

[54] SELF REGULATING VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

[75] Inventor: Bradford G. Amidzich, Oconomowoc, Wis.

[73] Assignee: Vent-Matic Co., Inc., Milwaukee, Wis.

[ * ] Notice: This patent is subject to a terminal disclaimer.

[21] Appl. No.: 09/098,268

[22] Filed: Jun. 16, 1998

[51] Int. Cl.[7] ..... B65D 83/00; B67D 5/54

[52] U.S. Cl. ..... 222/400.7; 222/396; 137/212

[58] Field of Search ..... 222/396, 397, 222/400.7, 400.8; 137/212, 322

[56] References Cited

U.S. PATENT DOCUMENTS

| | | | |
|---|---|---|---|
| 3,596,810 | 8/1971 | Taubenheim . | |
| 3,672,390 | 6/1972 | Gravesteijn | 222/400.7 |
| 4,125,209 | 11/1978 | Bailey . | |
| 4,142,658 | 3/1979 | Golding . | |
| 4,458,833 | 7/1984 | Bailey . | |
| 4,529,105 | 7/1985 | Lewins | 222/400.7 |
| 4,548,343 | 10/1985 | Gotch | 137/212 |
| 5,645,192 | 7/1997 | Amidzich | 222/1 |

FOREIGN PATENT DOCUMENTS 2123347 12/1971 Germany .

*Primary Examiner*—Kevin Shaver
*Assistant Examiner*—Keats Quinalty
*Attorney, Agent, or Firm*—Boyle Fredrickson Ziolkowski S.C.

[57] ABSTRACT

A valve assembly, securable in an upper opening of a container for liquids, is simple and inexpensive to manufacture yet provides improved operability and is capable of relieving excess gas pressure within the container. The valve assembly preferably includes a stub and a riser pipe/valving unit detachably mounted in the stub. The valving unit substantially consists of a unified riser pipe having blockable gas and/or liquid portals, and movable members arranged co-axially within two upper reception areas in the riser pipe and including a single sealing ring and a dispensing tower. The sealing ring is axially displaceable against the pressure of a spring to move from a neutral closed position to a lower open position by way of external activation. One of the sealing ring and the dispensing tower is movable axially relative to the other, under lifting forces imposed by excess gas pressure within the container, from a neutral closed position to a venting position, thereby venting some pressure from the container and regulating container pressure.

28 Claims, 21 Drawing Sheets

SELF REGULATING VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

BACKGROUND OF THE INVENTION

The invention relates to valve arrangements or valve assemblies and, in particular, relates to valve assemblies for transportable containers of the type serving to store and distribute a liquid under pressure from a propellant gas. The liquid to be stored and dispensed could comprise a beverage, a concentrate, a plant protection agent, or virtually any other transportable liquid.

The typical valve assembly of the above-mentioned type comprises (1) a ring-shaped stub secured in an upper opening of a container such as a barrel; (2) a valve housing; (3) a riser pipe arranged co-axially with an upper reception area in the valve housing such that the riser pipe and outlet valve can be displaced axially, against the biasing force of springs mounted within and about the valve housing, from an upper closed valve position to a lower open valve position; and (4) retaining parts which hold all parts in position within the stub. In previously-known valve assemblies of this type, the valve assembly can be readily disassembled before the gas pressure in the container has been fully relieved. Residual gas pressure in the container can force the valve components out of the container opening at high velocities with substantial risk to personnel and/or surroundings.

The problem of unauthorized disconnection of a pressurized container is addressed and at least partially solved in U.S. Pat. No. 5,242,092 to Riis et al. (the Riis patent). The valve assembly disclosed in the Riis patent includes, in addition to the stub, the riser pipe, valves, and springs, an obliquely and downwardly protruding finger provided on the lower free end of the riser pipe. The finger is spaced from the top of the riser pipe and cooperates with the remainder of the riser pipe such that the valve can only be dismounted completely when the riser pipe is in or in the vicinity of its bottommost position. Since pressure within the container forces the riser pipe upwardly and the finger therefore can be pushed into its lower position only in the absence of significant pressure within the container, the finger functions to prevent damage which might occur if unauthorized persons were to attempt to disconnect the valve before the gas pressure in the container has been completely relieved.

The valve assembly disclosed in the Riis patent, though solving at least one of the problems exhibited by most valve assemblies, does not solve other problems associated with conventional valve assemblies. For instance, it cannot relieve excessive gas pressures within the container which may be generated when the container is subjected to external forces such as excessive shaking or other mechanical agitation or fire or other thermal agitation. The valve assembly disclosed in the Riis patent and other, traditional valve assemblies are designed only to keep the contents within the container, not to regulate the pressure within the container. Hence, traditional valve assemblies cannot prevent gas pressures within the container from reaching or even exceeding explosive levels in the presence of external agitation forces. Even if these external forces are less severe such that gas pressures within the container do not reach explosive levels, the higher-than desired pressure within the container still may render the contents dangerous to handle when making connection to dispensing equipment.

Another problem associated with previously-known valve assemblies is the problem of unintended and premature liquid escape during valve coupling. Presently-available valve assemblies are designed to cooperate with a coupling head which can be fixed in the valve or on the stub to form a sealed coupling. The coupling head, such as that manufactured by Perlick under the model number MK-1, connects the valve with a source of pressurized gas and with a liquid dispenser such as tapper. When the coupling head is seated and activated, an axially displaceable spindle is forced downwardly, setting-in-motion a two stage valve opening sequence. First the spindle comes in contact with the liquid valve plug, forcing it downwardly against a spring within the riser pipe, thereby opening the liquid passage. The spindle continues downwardly while making contact with the riser pipe itself, forcing the riser pipe downwardly against a second spring so that the riser pipe moves downwardly opening the gas passage, thereby completing the sequence and theoretically dispensing liquid only after the coupling head has been sealed and gas pressure has been applied. However, due at least in part to the fact that there are two separate pathways in the present assemblies, one being for gas and one for liquid, the liquid contents of the container is pushed to the very exit point of the liquid pathway by pre-existing gas pressure within the container. Now, when a per-activated coupling head is pressed into the I.D. of the housing, it will enter the liquid pathway before the coupling head seals against the container, thereby allowing the liquid contents to escape from the valve assembly and into the ambient atmosphere during the interval of time between initial liquid pathway opening and the time that the coupling head seals against the container.

It can thus be seen that previously-existing valve assemblies do not self-regulate pressure in the container, are complicated structures, and therefore are expensive to manufacture. In addition, valve coupling and uncoupling are cumbersome and time-consuming operations which risk substantial liquid spills.

OBJECTS AND SUMMARY OF THE INVENTION

A first object of the invention is to provide a valve assembly which is configured to supply gas to a container and to dispense a liquid from the container under the resultant internal container pressure and which can self-regulate the internal container pressure.

Another object of the invention is to provide a valve assembly which meets the first object and which is retrofitable to existing containers.

Another object of the invention is to provide a valve assembly which meets at least the first object of the invention and which is simpler and more cost effective to manufacture and assemble than traditional valve assemblies.

A further object of the invention is to provide a valve assembly which meets at least the first object and which exhibits improved flow rates of ingress and egress.

Another object of the invention is to provide a valve assembly which meets the first object of the invention and which permits control of the sequencing of valve portal exposures to open and close.

Still another object of the invention is to allow only gas to be present at the egress portals of a valve assembly meeting the first object until a coupling seal is made, thereby preventing liquid spills.

A still further object of the invention is to facilitate valve assembly coupling and uncoupling.

In a particularly simple and advantageous embodiment of the invention, these objects are achieved by providing a valve assembly having (1) a single chamber which acts as the riser pipe and the valve housing interior with portals that are blockable, and (2) a central tower which communicates with blockable pathways that pass both liquid and gas, and (3) a bidirectional valve member which controls separation of gas and liquid and directional flow in the chamber, which allows only gas to be present at the point of coupling transition until the valve assembly is fully coupled, and which regulates the internal gas pressure of the container when no coupling is engaged. Moreover, according to the invention, fewer parts are used in the same space, allowing greater cross sectional ingress and egress areas, thereby improving fill and discharge rates and reducing costs to the end user while providing improved safety. The parts can be made to retrofit existing equipment which is also a cost incentive.

Specifically, the valve includes a riser pipe, a dispensing tower, and a sealing ring. The riser pipe, which is configured for mounting in an opening in the container, has an internal surface, a first end located remote from the opening, and a second end located adjacent the opening. An ingress/egress portal is formed in the riser pipe between the first and second ends thereof. The dispensing tower, which is positioned radially within the riser pipe, extends at least generally in parallel with the riser pipe. A chamber is formed between the external surface of the dispensing tower and the internal surface of the riser pipe. The sealing ring is positioned within the chamber and is slidable downwardly within the chamber (1) from a first position in which the sealing ring seals against the internal surface of the riser pipe at a location above the ingress/egress portal, and in which the sealing ring seals against the external surface of the dispensing tower and prevents fluid from flowing out of the valve assembly, and (2) to a second position in which the sealing ring seals against the internal surface of the riser pipe at a location beneath the ingress/egress portal allowing gas to flow into the container and prevent liquid from entering the gas chamber and in which the sealing ring seals against the external surface of the dispensing tower beneath the ingress/egress portal of said tower allowing liquid to pressure seal the riser pipe and permit liquid flow out of the container. Additionally, in an alternative embodiment, the dispensing tower is also positioned within the chamber and so as to be slidable downwardly (1) from a first position in which the external surface of the dispensing tower sealing engages a lip formed in the upper portion of the internal surface of the sealing ring, and (2) to a second position in which the dispensing tower is pressed downwardly to allow liquid to flow through the opening between the dispensing tower and the sealing ring and out of the container. Preferably, the relative positional relationship between the sealing ring, the riser pipe, and the dispensing tower is variable such that, in the event of a build-up of excessive gas pressure within the container, a pressure relief operation automatically commences in which at least one of the sealing ring and the dispensing tower move axially relative to the riser pipe. Upon this relative movement, the dispensing tower ingress/egress portals are exposed to atmosphere and vent excess pressure.

Another object of the invention is to provide an improved sealing ring for a valve assembly.

Still another object of the invention is to provide an improved method for dispensing liquid from a container under internal gas pressure within the container.

In accordance with still another aspect of the invention, this object is achieved by mechanically driving a sealing ring to move downwardly within the chamber (1) from a first position preventing gas or liquid flow out of the valve assembly, and (2) to a second position in which gas flows through the ingress/egress portal from above the sealing ring and liquid flows past the sealing ring from below and out of the valve assembly.

Preferably, gas pressure, generated within the container due to thermal or other external agitation, causes at least one of the sealing ring and the dispensing tower to move axially relative to the riser pipe such that the sealing ring seals against the retaining ring and/or riser pipe surface. Upon this relative movement, the dispensing tower ingress/egress portals are exposed to atmosphere and vent excess pressure.

The foregoing and other features and advantages of the invention will become apparent from the following detailed description of the preferred embodiments, read in conjunction with the accompanying drawings. The detailed description and drawings are merely illustrative rather than limiting, the scope of the invention being defined by the appended claims and equivalents thereof.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
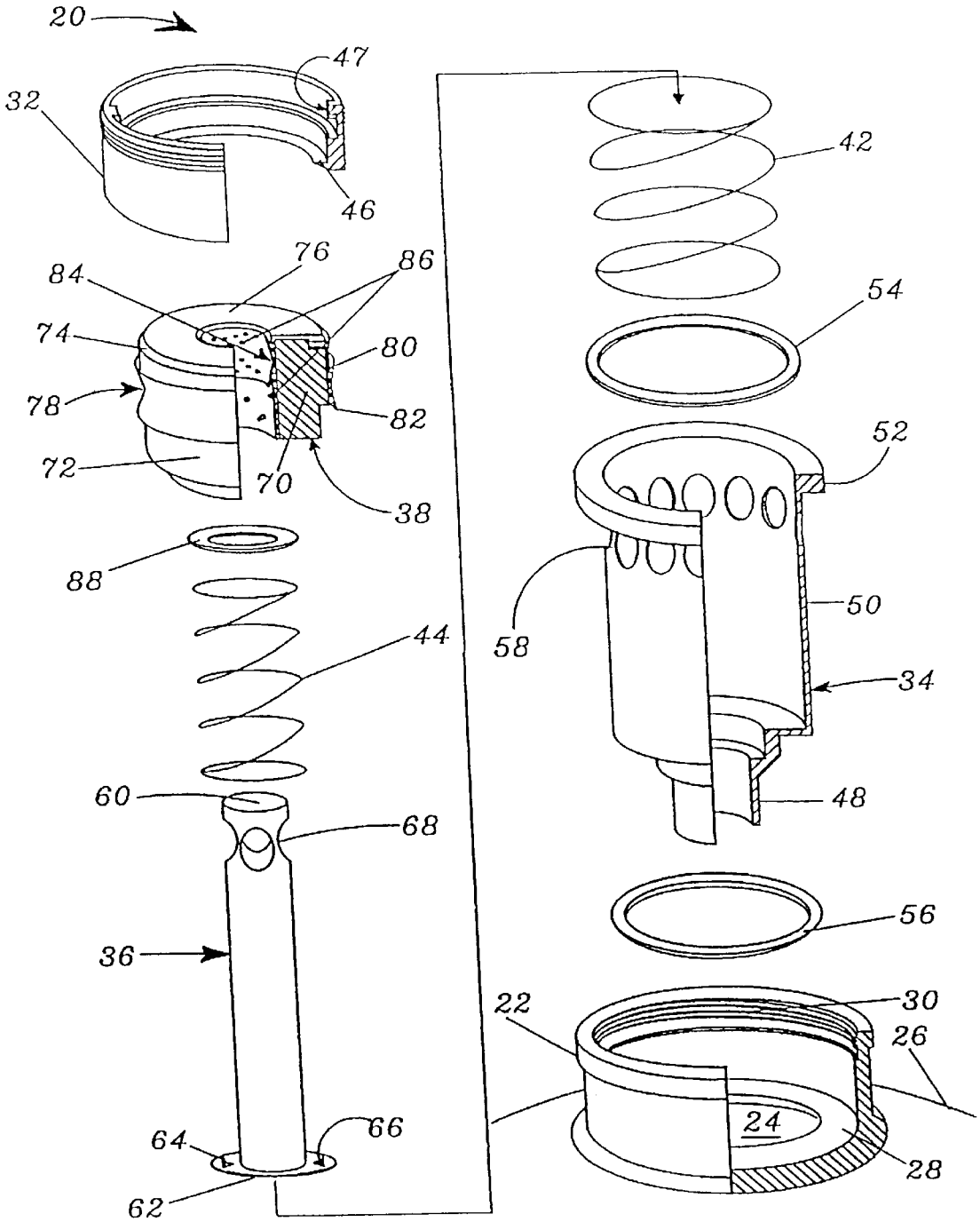
FIG. 1 is an exploded perspective view of the individual parts as they would be assembled together so as to make up a valve assembly according to a first embodiment of the invention.

Pursuant to a preferred embodiment of the invention, a valve assembly has (1) a single chamber which acts as the riser pipe and the valve housing interior with portals that are blockable, and (2) a central tower which communicates with blockable pathways that pass both liquid and gas, and (3) a bi-directional valve member which controls separation of gas and liquid and directional flow in the chamber, which allows only gas to be present at the point of coupling transition until the valve assembly is fully coupled, and that regulates the internal gas pressure of the container when no coupling is engaged. Fewer parts are used in the same space, allowing for greater cross-sectional ingress and egress areas, thereby improving fill and discharge rates and reducing costs to the end user while providing improved safety. The parts can be made to retrofit existing equipment.

2. Description of First Embodiment

Turning now to the drawings and initially to FIGS. 1–4 in particular, the inventive valve assembly 20 is designed for connection to a standard stub 22 surrounding an aperture 24 in a container 26. Container 26 may comprise a barrel or any other transportable or stationary structure for storing beverages or other liquids and for dispensing the stored liquids under gas pressure. The stub 22 coaxially surrounds the aperture 24 in the container 26 and is fixed to the container 26, e.g., by welding. Stub 22 presents an internal radial shoulder 28 supporting the riser pipe 34 as detailed below and also presents upper radial threads 30 for connection to a housing 32 of the valve assembly 20 also as detailed below.

Valve assembly 20 includes as its major components a housing 32 which also functions as a retainer for the remaining components of the valve assembly 20, a stationary riser pipe 34, a dispensing tower 36, and a sealing ring 38. An annular chamber 40 is formed between the dispensing tower 36 and the riser pipe 34. This single chamber 40 contains liquid and/or gas depending upon the vertical position of sealing ring 38 within the chamber 40. Dispensing tower 36 of the illustrated embodiment is movable vertically with respect to the riser pipe 34. The sealing ring 38 and dispensing tower 36 are biased towards the positions illustrated in FIG. 2 by first and second springs 42 and 44 detailed below.

The housing 32, which is threaded into the threads 30 of the stub 22, serves to enclose the remaining components of the valve assembly 20 and to retain them in place during operation of the assembly. The housing 32 presents an internal ring 46 which defines an upper limit of travel of the sealing ring 38 as detailed below. Housing 32 also presents inwardly-extending radially lugs 47 for cooperation with a conventional coupling head in a manner which is, per se, well known.

The riser pipe 34 functions both to serve as a housing and outer seat for the sealing ring 38 and as a more traditional pipe for directing liquid in the container 26 into the upper portions of the valve assembly 20 from the lower portions of the container. The riser pipe 34 is stepped so as to present a lower portion 48 of relatively narrow diameter separated from an upper portion 50 of relatively large diameter by a shoulder. Upper portion 50 surrounds the chamber 40 and slidably receives and guides the sealing ring 38. An outwardly radially extending flange 52 is formed on the upper end of the riser pipe 34 and is clamped between the shoulder 28 of the stub 22 and the bottom end of the housing 32 with the aid of upper and lower sealing rings or gaskets 54 and 56. A plurality of circumferentially-spaced ingress/egress portals or openings 58 are formed in the upper portion 50 of the riser pipe 34 at a location beneath the flange 52.

The purpose of the dispensing tower 36 is to provide a pathway for flow of liquid or gas (depending upon the operational state of the valve assembly) out of the container 26, to guide the inner periphery of the sealing ring 38 during axial movement thereof, and to cooperate with the sealing ring 38 to selectively prevent and permit fluid flow from the container 26. The dispensing tower 36 is sealed at its upper end by a cap 60 preferably formed integrally with the tubular tower. The lower end of the dispensing tower 36 is open and presents an outwardly extending radial flange 62 which normally rests on the shoulder of the riser pipe 34. Triangular projections 64 are punched upwardly from the flange 62. Projections 64 radially center the spring 44 and prevent excessive radial movement of the bottom end of the spring 44. A plurality of openings 66 are formed in the flange 62 when the projections 64 are punched. The openings 66 assure free flow of fluid between the annular chamber 40 and the interior of the riser pipe 34. In addition, a plurality of circumferentially spaced discharge openings or portals 68 are formed through the wall of the dispensing tower 36 near its upper end.

The sealing ring 38 performs two functions. First, it serves as a valve element, selectively opening and closing the portals 58 and 68 and exposing them to various fluids, i.e., either a gas or a liquid. Secondly, it guides the dispensing tower 36 and maintains the perpendicularity and eccentricity between the sealing ring 38, the dispensing tower 36, and the riser pipe 34, thereby enhancing sealing. The sealing ring 38 could conceivably be formed entirely out of rubber or another polymeric material but, in the illustrated embodiment (FIG. 2), is formed from an inner, rigid, thermally degradable, insert 70 surrounded by a layer 72 of a molded polymeric material such as synthetic or natural rubber.

Figure 2:
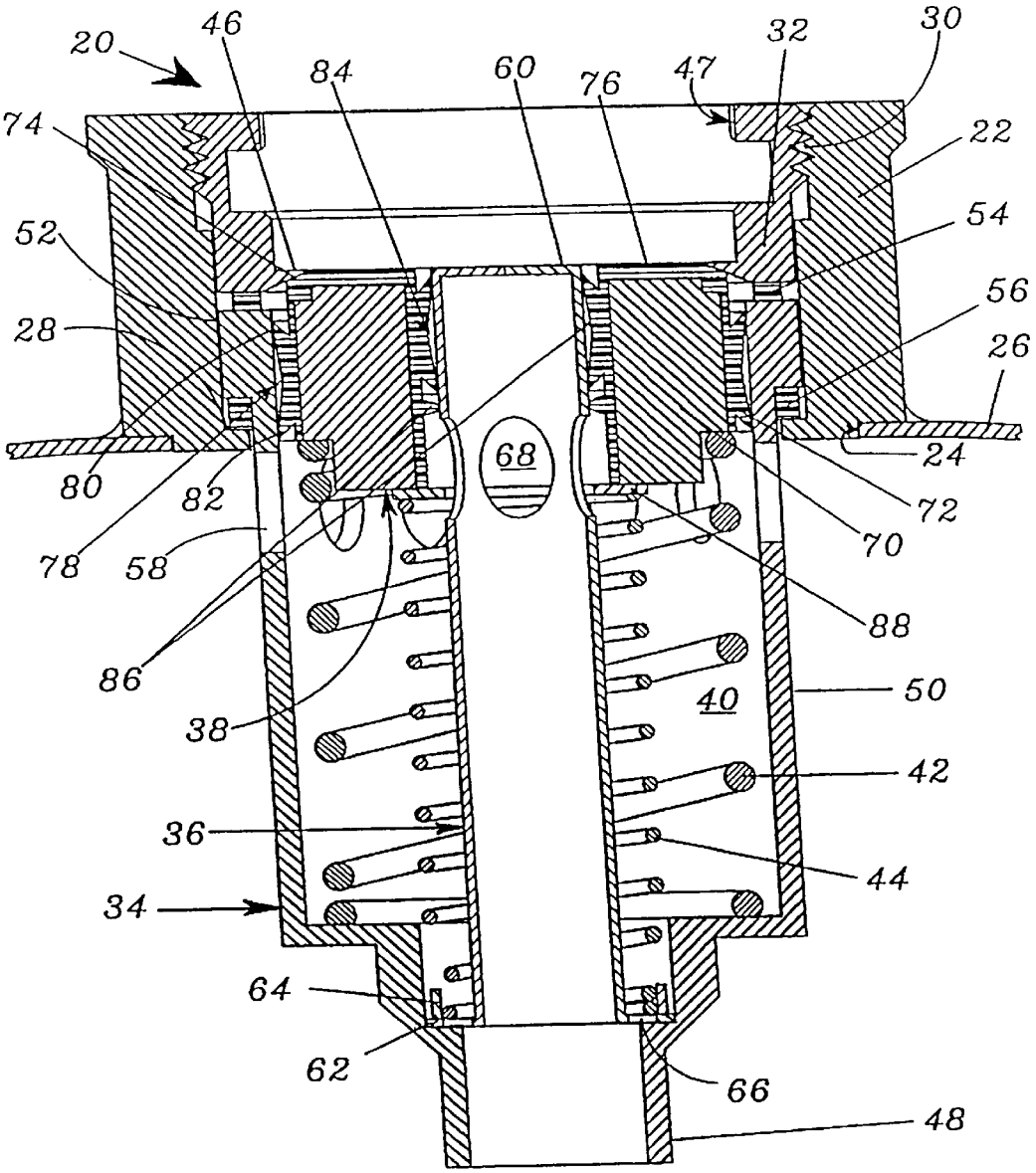
FIG. 2 is a sectional elevation view of the valve assembly of FIG. 1 and illustrating the valve assembly in its neutral or closed mode.

The outer portion of the upper end of the sealing ring 38 presents a chamfer 74 which complements the shape of the retaining ring 46 of housing 32, 74 seals against 46 when the sealing ring 38 is in its uppermost position illustrated in FIG. 2. The inner radial portion of the upper end surface of the sealing ring 38 presents a flat sealing face 76 for contact with a spindle as detailed below. A first circular sealing lip 78 extends radially outwardly from the outer periphery of the sealing ring 38 and engages and seals against the internal surface of the riser pipe 34. The first sealing lip 78 is generally V-shaped and includes an upper sealing surface 80 and a lower sealing surface 82 both of which engage the internal surface of the riser pipe 34 and between which is formed an annular space that reduces contact friction and make the sealing lip very pliant. This can be enhanced with very slender annular face rib(s) on sealing surface 80 and 82 (not present in this embodiment). This generally V-shaped configuration of the lip 78 (1) provides bidirectional sealing at very low pressure, preventing fluid from flowing past the lip 78 either from above or below and (2) facilitates initial movement of the sealing ring 38 within the riser pipe 34 and prevents damage or abrasion of the sealing ring 38. A second circular V-shaped lip 84 extends radially inwardly from the inner peripheral surface of the sealing ring 38 and is positioned above the discharge portals or openings 68 when the valve assembly 20 is in its neutral or closed position illustrated in FIG. 2. Finally, a plurality of frusto-conical centering projections 86 extend radially from the sealing ring 38. These projections 86 could extend from the inner peripheral surface of the sealing ring 38 as illustrated, from the outer peripheral surface, or from both. They also could be supplemented or replaced by diagonal, and/or spiral, or vertical ribs (not present in this embodiment). These projections 86 guide and stabilize the sealing ring 38 with respect to the member they contact (the dispensing tower 36 in the illustrated embodiment) while maintaining the eccentricity of these elements and permitting the free-flow of fluid past the projections 86. The illustrated projections 86 are formed integrally with the polymeric layer 72, but it is conceivable that they could be formed from a separate structure or even from projections of the insert 70 extending through the polymeric layer 72. Sealing ring 38 is biased into its uppermost position illustrated in FIG. 2 both by the first or sealing spring 42 and the second or vent spring 44. The sealing spring 42 is seated against the bottom surface of the insert 70 at its upper end and against a step in the riser pipe 34 at its upper end. The second or vent spring 44 is seated at its lower end against the flange 62 of the dispensing tower 36 and at its upper end against a spacer 88 positioned between the spring 44 and the bottom surface of the polymeric layer 72.

Figure 3:
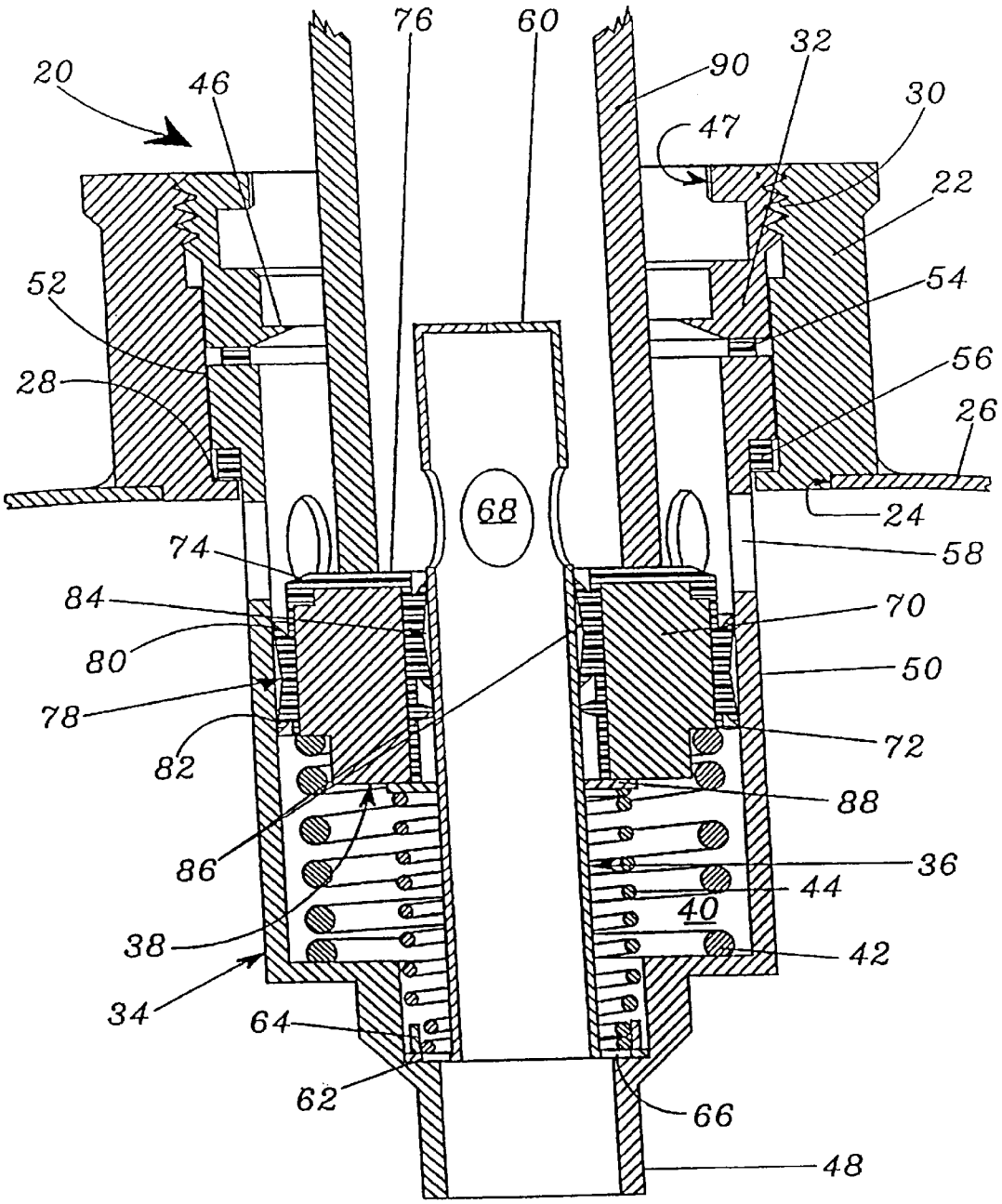
FIG. 3 is a sectional elevation view of the valve assembly of FIGS. 1 and 2 and illustrating the valve assembly in its normal or working mode.
Figure 4:
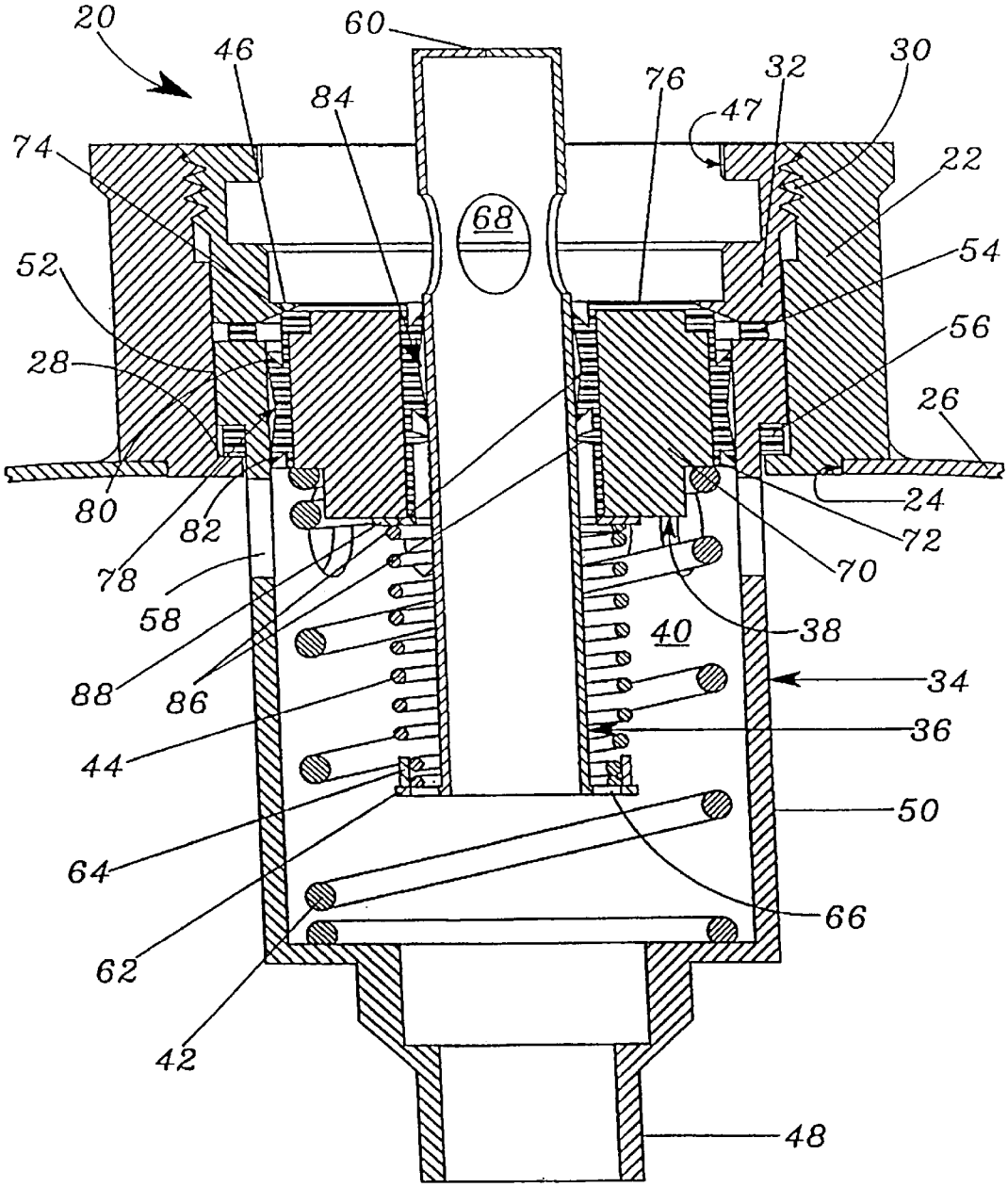
FIG. 4 is a sectional elevation view of the valve assembly of FIGS. 1–3 and illustrating the valve assembly in its pressure release or venting mode.
Figure 5:
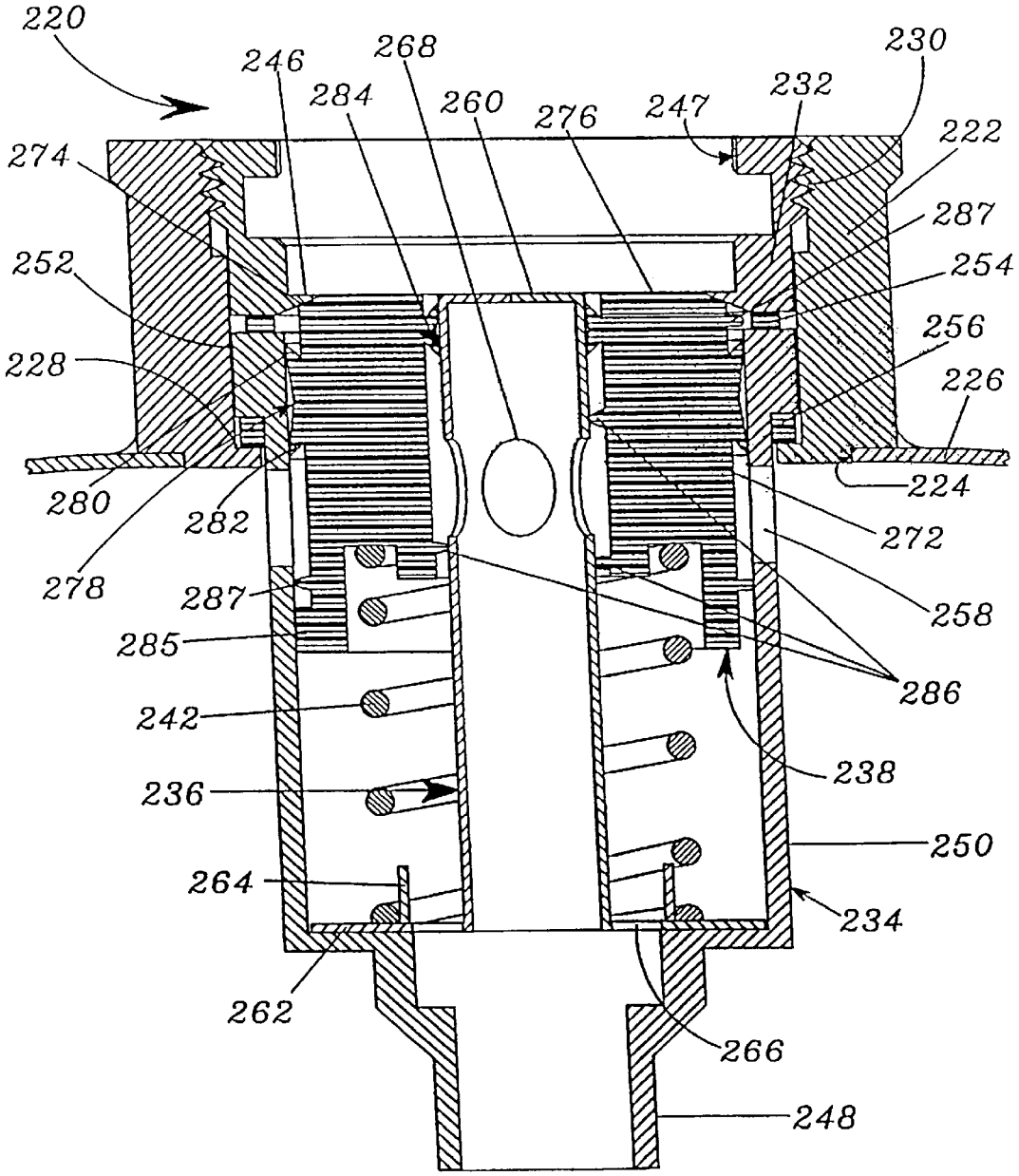
FIG. 5 is a sectional elevation view of a valve assembly according to a second embodiment of the invention and showing the valve assembly in its neutral or closed mode.

There are three modes of operation associated with the valve assembly 20 illustrated in FIGS. 1–4, namely: (1) neutral/closed (FIG. 2), (2) working/open to gas ingress and liquid egress (FIG. 3), and (3) venting/relieving excess pressure from within the container 26 (FIG. 4). A detailed discussion of each follows.

The neutral or closed position of the valve assembly 20 is illustrated in FIG. 2. The outer sealing lip 78 of the sealing ring 38 seals against the riser pipe 34 at a location above ingress/egress openings or portals 58, and the inner sealing lip 84 seals against the dispensing tower 36 at a location above the discharge portals 68. The chamfer 74 is held against the ring 46 of the housing 32 by the combined force of springs 42 and 44 and spacer 88. The arrangement of the members in this operational state differs from known assemblies in that the ingress/egress portals 58 and the discharge portals 68 share the same gas pressure, present throughout chamber 40 due to gas flow among the conical projections 86, thereby allowing the liquid in container 26 to seek its own level away from portals 58 and 68 via the inlet of the riser pipe 24. This in turn improves the coupling safety when a coupling arrangement is attached to the valve assembly 20.

Turning now to FIG. 3, the valve assembly 20 is placed in its second mode of operation in which it is open to gas ingress and liquid egress. Sealing ring 38 has been forced downwardly by a conventional fixed external coupling arrangement such as the arrangement manufactured by Perlick and marketed as Model No. MK-1. The conventional coupling arrangement includes an internal, axially displaceable, hollow spindle 90 which, when pressed downward, contacts the upper sealing face 76 of the sealing ring 38 (the ID of the spindle 90 being bored slightly if necessary to accommodate the present invention. In addition, an internal radially-extending riser stop and a separate internal V-shaped seal can if desired be added to the spindle) and forces the sealing ring 38 downwardly from the position illustrated in FIG. 2 to the position illustrated in FIG. 3. Coupling of the spindle 90 to the sealing face 76 creates (1) an ingress tube in the region located radially outside of the spindle 90 for flow of the propellant gas into the container 26, and (2) an egress tube within the spindle 90 for the flow liquid out of the container 26. The integrity of the gas and liquid separation at the circular line of contact between the spindle 90 and the sealing face 76 of the sealing ring 38 is maintained by the upward pressure of sealing spring 42. Seal integrity is enhanced further by the conical projections 86 and/or vertical ribs (not shown) fixed on the I.D. and/or O.D. walls of the sealing ring 38. As discussed above, these projections 86 serve to guide and stabilize the perpendicularly and eccentricity between the sealing ring 38, dispensing tower 36, and riser pipe 34, thereby enhancing the sealing of the outer and inner sealing lips 78 and 84 of the sealing ring 38 as they move downwardly past the ingress/egress openings or portals 58 of riser pipe 34 and the discharge openings or portals 68 of dispensing tower 36, respectively.

It is important to note that the sequence of portal overlap and exposure is timeable by setting differential relationships between the sealing lip and portal locations during valve manufacture. The valve assembly 20 therefore can be readily modified to allow the valve assembly 20 to mix more then one liquid or gas in the same chamber 40, with the differential between them being controllable by design.

When the sealing ring 38 is forced downwardly to the position illustrated in FIG. 3, (1) the ingress/egress portals 58 are exposed to propellent gas flowing into the valve assembly 20 from the region surrounding the spindle 90, and (2) the discharge portals 68 are exposed to the internal fluid discharge passage of the spindle 90. Outer sealing lip 78 prevents the propellant gas from entering the liquid at a location just below portals 58. Sealing lip 78 therefore preserves ingress propellant pressure integrity as the gas flows into the container 26. In addition, the sealing lip 78 prevents liquid from entering the ingress/egress portals 58 and thus closes the riser pipe being off to its gas connection. This in turn forces the gas now entering the container 26 through the ingress/egress portals 58 to push the liquid up into the lower inlet of the riser pipe 34, up through the center of dispensing tower 36, and out of the dispensing tower 36 through the discharge portals 68. The discharged liquid then flows through the spindle 90 and is dispensed from the system in a conventional manner.

Conversely, when there is no external coupling attached to valve assembly 20, springs 42 and 44 return the sealing ring 38 to its neutral or closed mode as illustrated in FIGS. 2 and 4, thereby containing liquid and gas within container 26 for transport. The inventive valve assembly 20 therefore exhibits the same benefit as previously-known valve assemblies which also contain liquid and gas within their containers for transport when they are closed.

However, unlike conventional valve assemblies, the inventive valve assembly 20 also is capable of operating in a pressure relief mode. Pressure relief is desirable because the contents of the container 26 can be exposed to thermal agitation such as fire or mechanical agitation such as excessive shaking. External agitation may cause gas pressure within the container 26 to build-up to a level that is high enough to breach the container's integrity with devastating consequences. This potential overpressurization is avoided by permitting the valve assembly 20 to assume the mode illustrated in FIG. 4 in which pent-up gas pressure within the container 26 overcomes the seal between the inner sealing lip 84 of the sealing ring 38 and the dispensing tower 36. That is, gas pressure acting on the dispensing tower 36 forces the tower 36 upwardly against the spring 44 to a position where portals 68 vent. Since the sealing ring 38 is held from upward movement by the ring 46 of the housing 32, the discharge or egress portals 68 of the discharge tower 36 move beyond the inner sealing lip 84 to permit excess pressure within the container to flow past the riser pipe 34, through ingress/egress portals 58, through the dispensing tower 36, and out of the valve assembly 20 through the discharge portals 68. It should be noted that, because upward movement of the dispensing tower 36 is resisted primarily by the spring 44, the threshold pressure above which relief or venting occurs is determined by the strength of the spring 44 and can be set by selecting a spring of a designated strength. In those instances in which overpressurization results from thermal agitation caused by fire or the like, pressure release can be accelerated through thermal degradation of the insert 70 and consequent ejection of the entire sealing ring 38 from the valve assembly 20.

The valve assembly could take many forms from that illustrated and described above without departing from the basic principals of operation. A first alternative construction of the inventive valve assembly will now be described.

3. Description of Second Embodiment

Referring to FIGS. 5–8, components of the valve assembly 220 of the second embodiment corresponding to components of the valve assembly 20 of the first embodiment (illustrated in FIGS. 1–4) are designated by the same reference numerals, incremented by 200. The valve assembly 220 of FIGS. 5–8 differs from the valve assembly 20 of FIGS. 1–4 in that (1) the sealing ring 238 is of slightly different design, (2) one of the springs of the first embodiment has been eliminated, and (3) dispensing tower 236 has been redesigned to accommodate the elimination of one of the springs. These discrepancies from the first embodiment will now be detailed.

Sealing ring 238 is configured for sliding movement in the chamber 240 in the same manner as the sealing ring 38 of the first embodiment. However, this sealing ring 238, unlike the sealing ring 38 of the first embodiment, is formed of a single unitary polymer member and thus lacks the rigidifying insert of the first embodiment. Additional centering projections 287 also are provided on the outer radial periphery of a sealing ring 238, and vertical centering ribs 285 are provided on the outer radial periphery to help guide the sealing ring 238 as it moves along the riser pipe 234.

The sole spring 242 of the second embodiment is designed to interact with the elastomeric sealing ring 238 to perform the combined functions of both springs 42 and 44 of the first embodiment. The spring 242 urges against the bottom surface of the sealing ring 238 at its upper end and against the annular flange 262 of the dispensing tower 236 at its lower end. The generally triangular projections 264 of this flange 262 are spaced further towards the inner edge of the flange 262 when compared to the corresponding projections 64 of the first embodiment to accommodate the larger spring. Finally, the relative positional relationship between the sealing lips 278 and 284, the ingress/egress openings or portals 258, and the discharge openings or portals 268 has been varied slightly to accommodate the revised sealing ring configuration.

Operation of the valve assembly 220 of the second embodiment is essentially identical to the operation of the valve assembly 20 of the first embodiment. Hence, when the valve assembly 220 is in its neutral closed mode illustrated in FIG. 5, the outer sealing lip 278 is located above the ingress/egress portals 258 and sealed against the internal surface of the riser pipe 234, the inner sealing lip 284 is located above the discharge portals 268 and sealed against the external surface of the dispensing tower 236, and the chamfer 274 is sealed against the ring 246. Accordingly, the entire portion of the chamber 240 beneath the sealing ring 238 is subject to whatever gas pressure exists within the container 226, and egress of fluids from the dispensing tower 236 is prohibited by the inner sealing lip 284.

Figure 6:
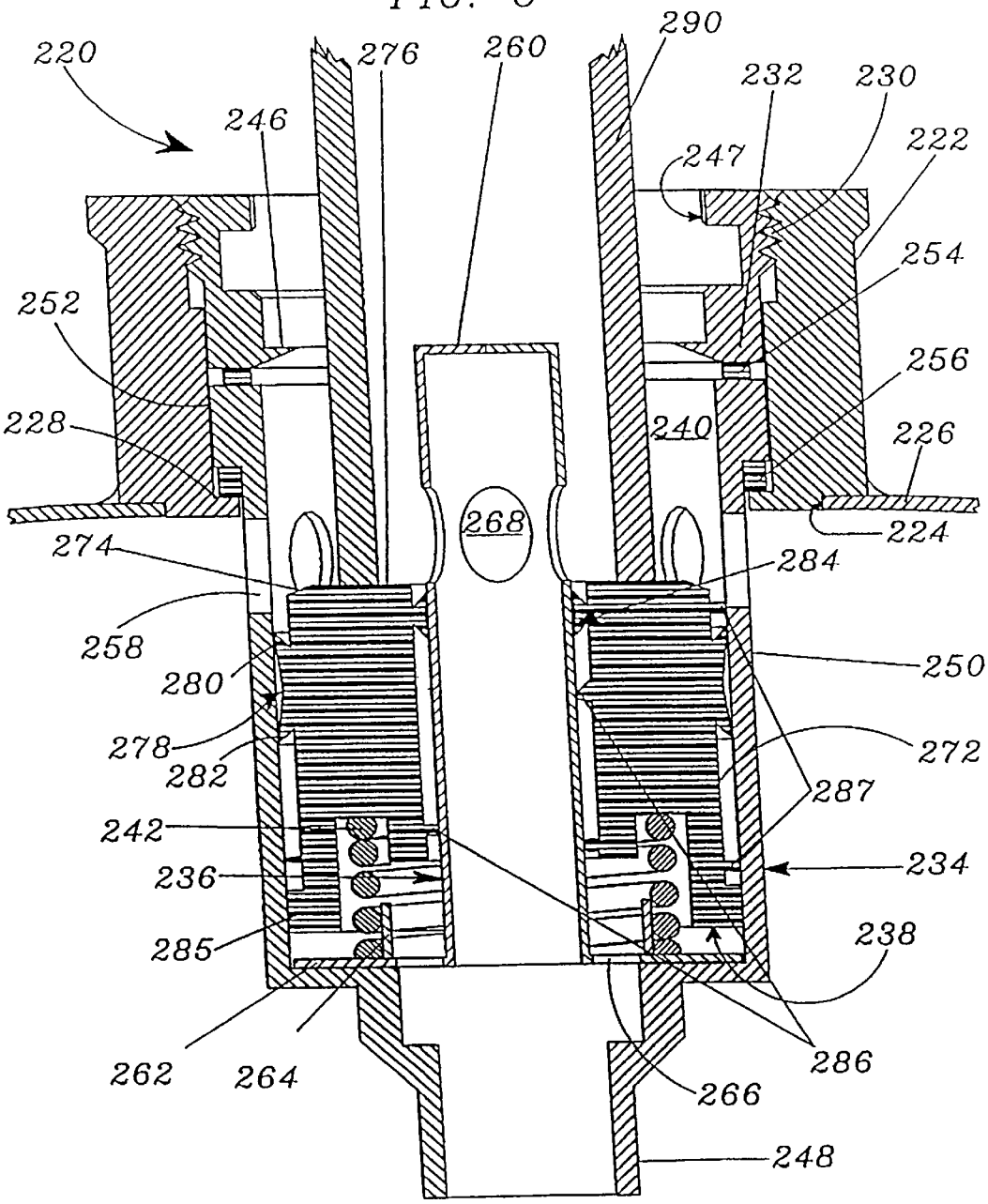
FIG. 6 is a sectional elevation view of the valve assembly of FIG. 5 and illustrating the valve assembly in its normal or working mode.

In the working mode, shown in FIG. 6, the sealing ring 238 of the second embodiment is forced downwardly by a hollow spindle 290 against spring 242 to the illustrated position in which the outer and inner sealing lips 278 and 284 are positioned beneath the respective rows of portals 258 and 268. The integrity of the gas and liquid separation at the interface between the spindle 290 and the sealing face 276 is maintained by the upward pressure of control spring 242. The inner and outer conical projections 286 and 287 and/or vertical ribs 285, fixed on the I.D. and/or O.D. walls of sealing ring 238, guide and stabilize the perpendicularity and eccentricity between the sealing ring 238, the dispensing tower 236, and the riser pipe 234, thereby enhancing the sealing of the lips 278 and 284 as they move downwardly past the discharge portals 268 of dispensing tower 236 and the ingress/egress portals 258 of riser pipe 234. As in the first embodiment, the sequence of portal blockage and opening is timeable by setting or altering the differential relationships between the sealing lip and portal locations. The operation of the valve assembly 220 in its working mode is otherwise the same as the operation of the valve assembly 20 of the first embodiment in its working mode and, accordingly, will not be detailed.

Figure 7:
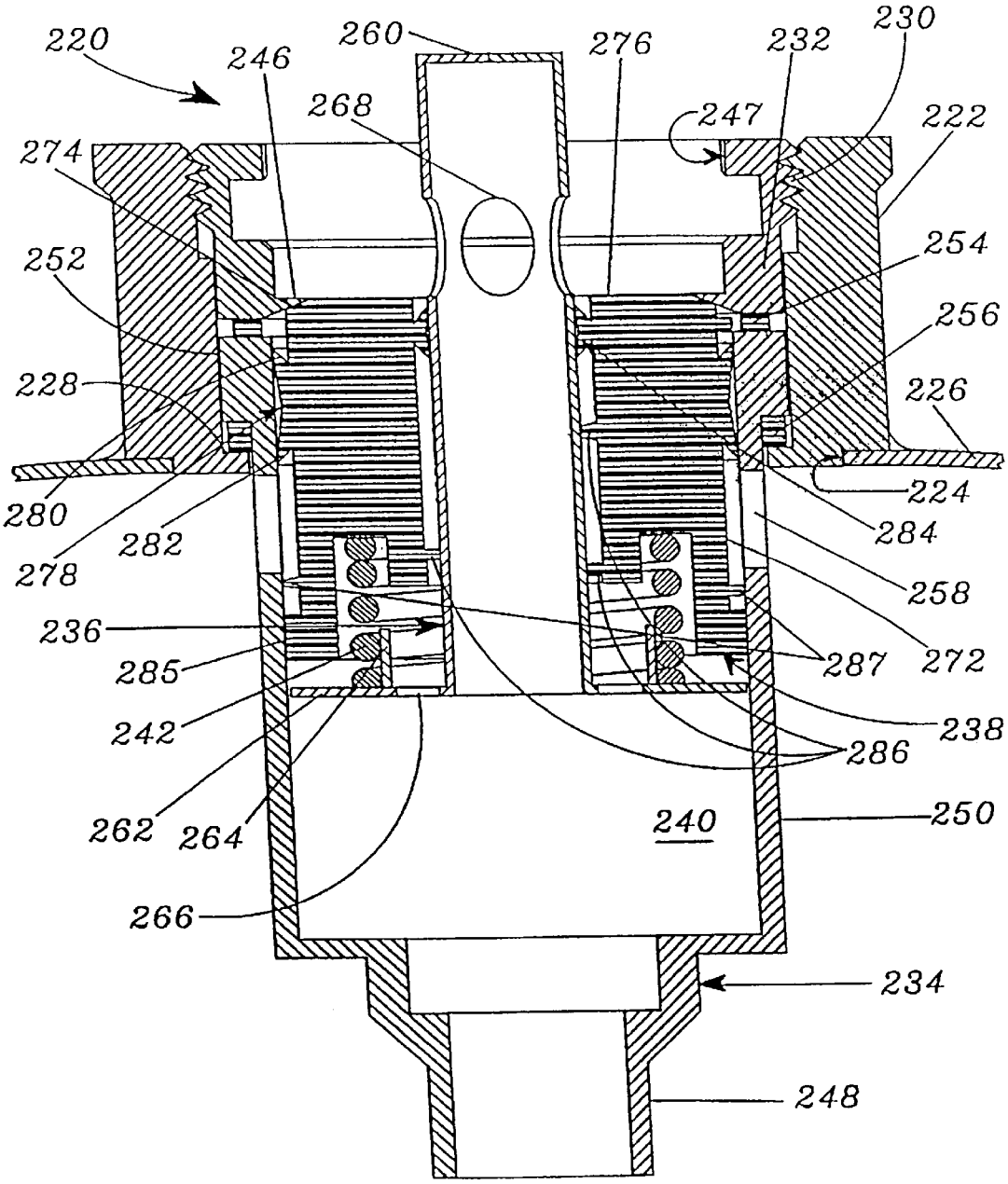
FIG. 7 is a sectional elevation view of the valve assembly of FIGS. 5 and 6 and illustrating the valve assembly in its pressure release or venting mode.
Figure 8:
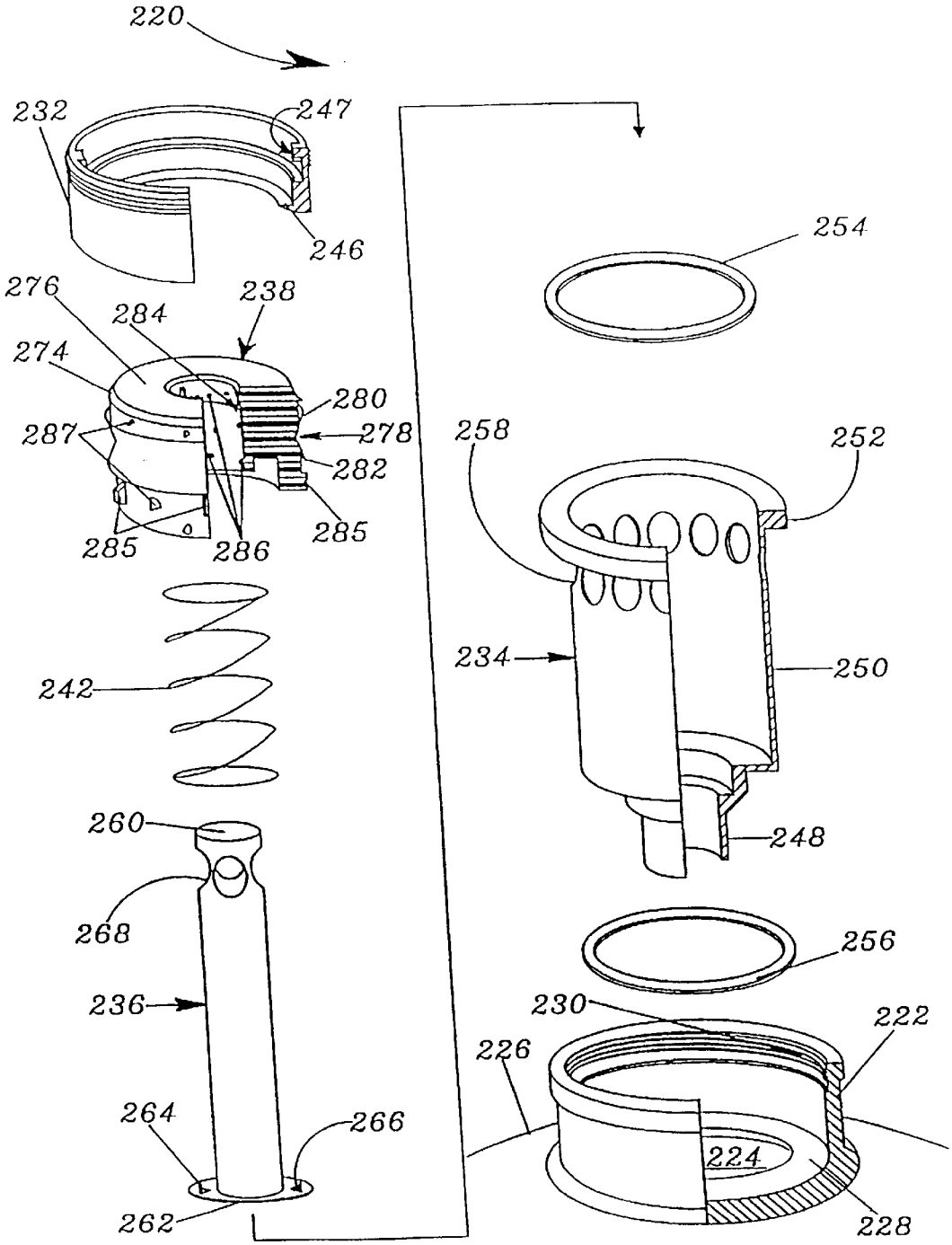
FIG. 8 is an exploded perspective view of the valve assembly of FIGS. 5–7.

Conversely, when, as illustrated in FIG. 7, there is no external coupling attached to the valve assembly 220, the sole spring 242 of the assembly returns the sealing ring 238 to its neutral or closed state, thereby containing liquid and gas within the container 226 for transport. However, if the contents of the container 226 become overpressurized due, e.g., to thermal agitation, the excess pent-up pressure will force dispensing tower 236 upwardly against the force of control spring 242 to the illustrated position venting said pressure through discharge portals 268 which are now located above the inner sealing lip 284 of the sealing ring 238, in the same manner detailed above in connection with the first embodiment.

4. Description of Third Embodiment

Turning now to FIGS. 9–12, a valve assembly 320 constructed in accordance with a third embodiment of the invention is illustrated which is similar to the valve assembly 220 of the second embodiment. Components of the third embodiment corresponding to those of the second embodiment are, accordingly, designated by the same reference numerals, incremented by 100.

The valve assembly 320 of the third embodiment differs from the valve assembly 220 of the second embodiment primarily in that the dispensing tower 336 takes the form of an imperforate standpipe assembly rather than a perforated hollow pipe. The dispensing tower 336 therefore includes an upper head 361 of relatively large diameter and a lower shank 363 of relatively small diameter separated by a downwardly facing shoulder 369 on the head 361. An annular plate 362 is affixed to the bottom end portion of the shank 363 and serves the same function as the annular flange 262 of the second embodiment, namely, it supports the spring 342 and has projections 364 bent upwardly therefrom to guide the spring 342 and to form opening 366 for fluid flow through the plate 362. The ribs 385 are mounted on the shank 363 rather than the sealing ring 338 to illustrate that centering devices could be mounted on either or both members.

The sealing ring 338 of the third embodiment differs from the sealing ring 238 of the second embodiment in that its inner portion is modified to cooperate with the standpipe or dispensing tower 336. Specifically, as is clearly illustrated in the drawings, the inner peripheral surface of the sealing ring 338 is stepped so as to present an axial shoulder or sealing face 377 on which the mating shoulder 369 of the dispensing tower 336 sealingly rests when the valve assembly 320 is in its neutral or closed mode illustrated in FIG. 9. In the other two modes of operation, illustrated in FIGS. 10 and 11, respectively, sealing face 377 is spaced from the shoulder 369 of the dispensing tower 336 to permit fluid flow therepast and out of the valve assembly 320.

The operation of the valve assembly 320 of the third embodiment is generally the same as the operation of the valve assembly 220 of the second embodiment. The sealing ring 338 moves downwardly within the chamber 340, under the action of a spindle 390 of a coupling head and against the biasing force of the spring 342, from its neutral or closed position illustrated in FIG. 9 to its working or open position illustrated in FIG. 10. The integrity of the gas and liquid separation at the spindle-to-sealing ring coupling is maintained before and after this motion by the upward pressure of control spring 342 and by conical projections 386 and 387 and/or vertical ribs 385, which help stabilize the perpendicularly and eccentricity between the sealing ring 338, dispensing tower 336, and riser pipe 334, thereby enhancing the sealing of the sealing lip 378 as the sealing ring 338 moves downwardly past the ingress/egress portals 358 of the riser pipe 334. Movement of the sealing ring 338 relative to the dispensing tower 336 causes the sealing face 377 of the sealing ring 338 to separate from the mating shoulder 369 on the dispensing tower 336, thereby permitting liquid to flow between the sealing ring 338 and the dispensing tower 336, out of the valve assembly 320, and into the egress tube formed by the spindle 390. As in the previous embodiments, this is a sequence that is timeable by altering the differential relationships between the sealing lip and portal and shoulder locations. The operation of the valve assembly 320 in its working mode is otherwise the same as in the first and second embodiments and, accordingly, will not be detailed.

Figure 9:
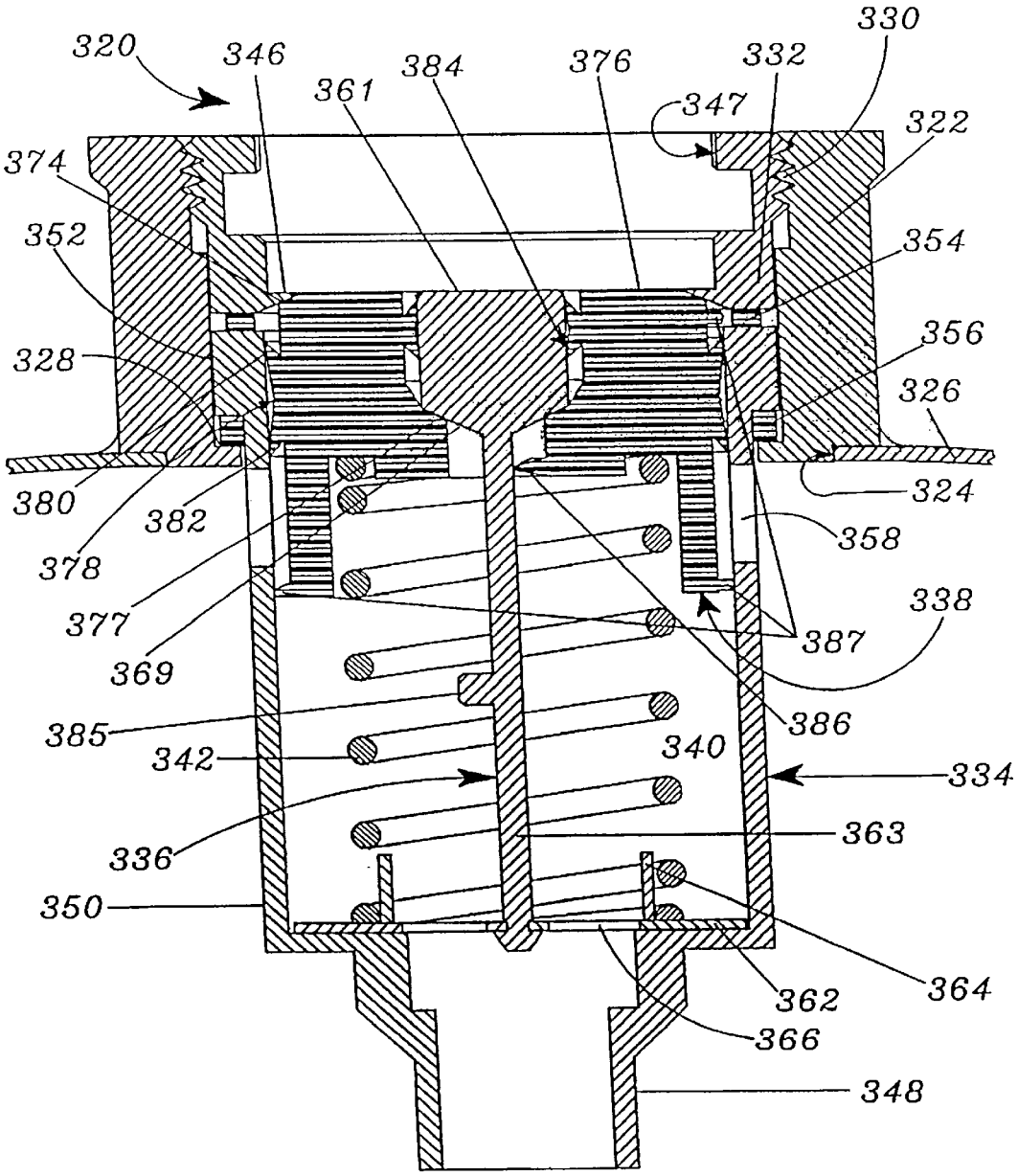
FIG. 9 is a sectional elevation view of a valve assembly according to a third embodiment of the invention and showing the valve assembly in its neutral or closed mode.
Figure 10:
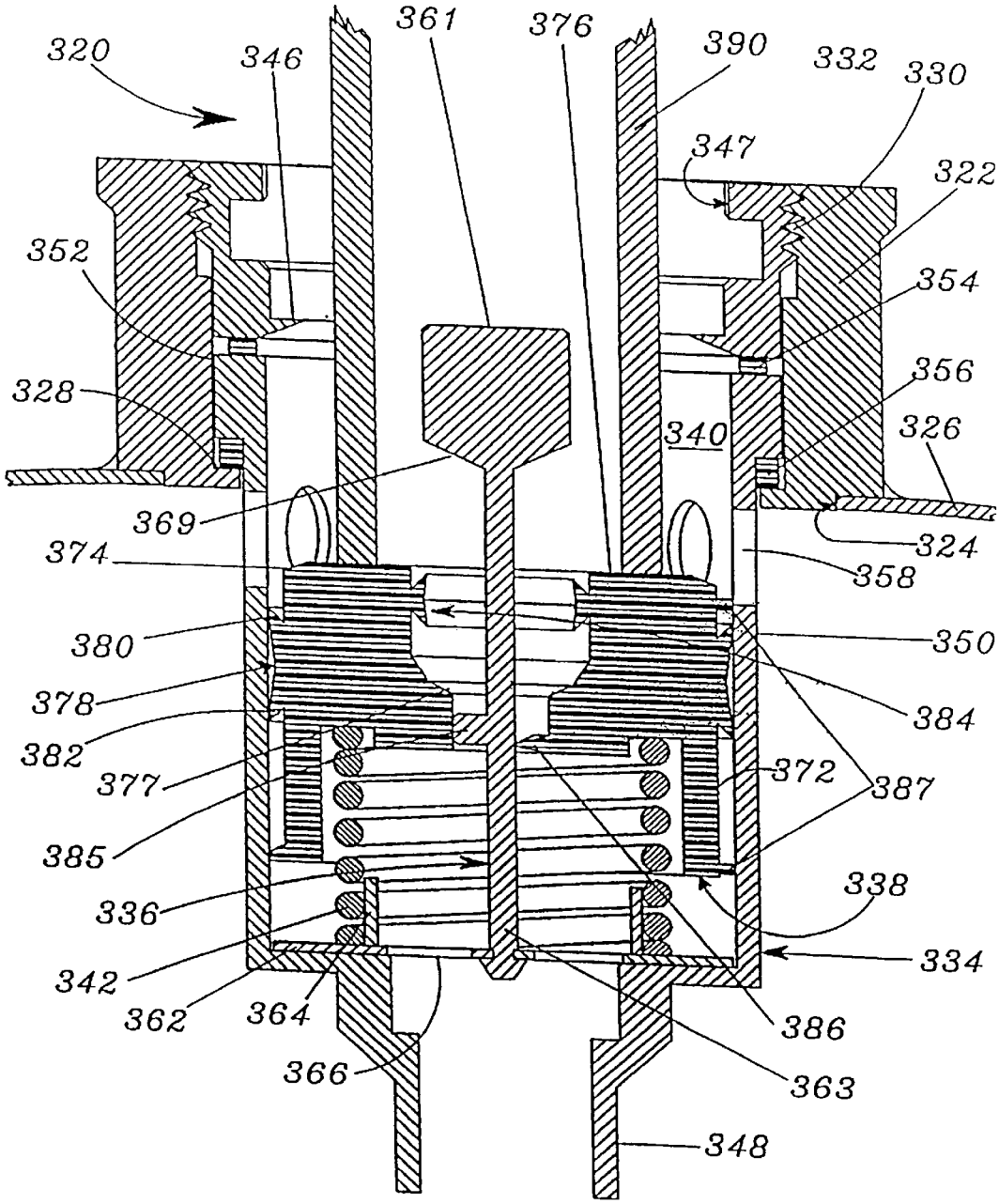
FIG. 10 is a sectional elevation view of the valve assembly of FIG. 9 and showing the valve assembly in its normal or working mode.
Figure 11:
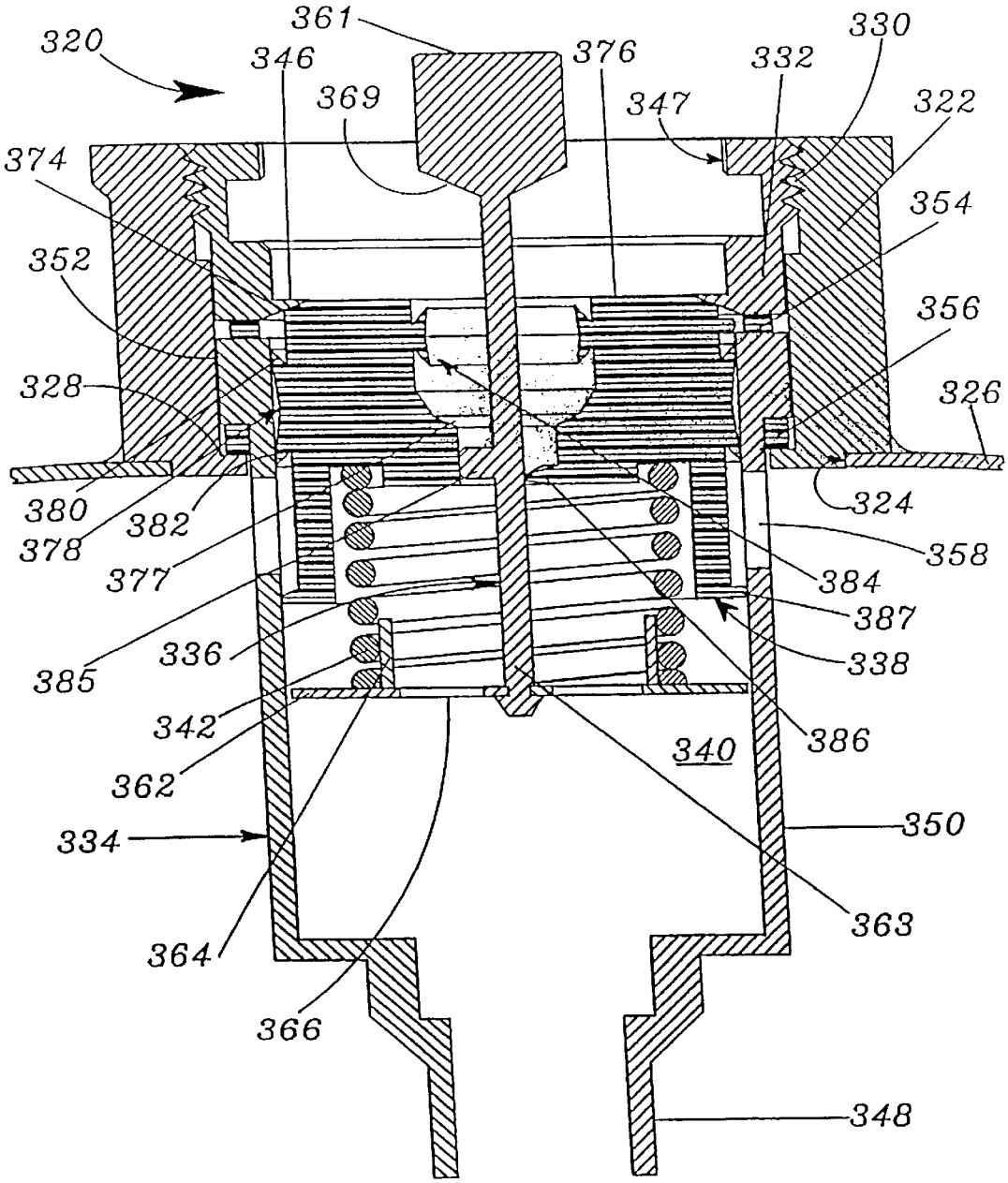
FIG. 11 is a sectional elevation view of the valve assembly of FIGS. 9 and 10 and showing the valve assembly in its pressure release or venting mode.
Figure 12:
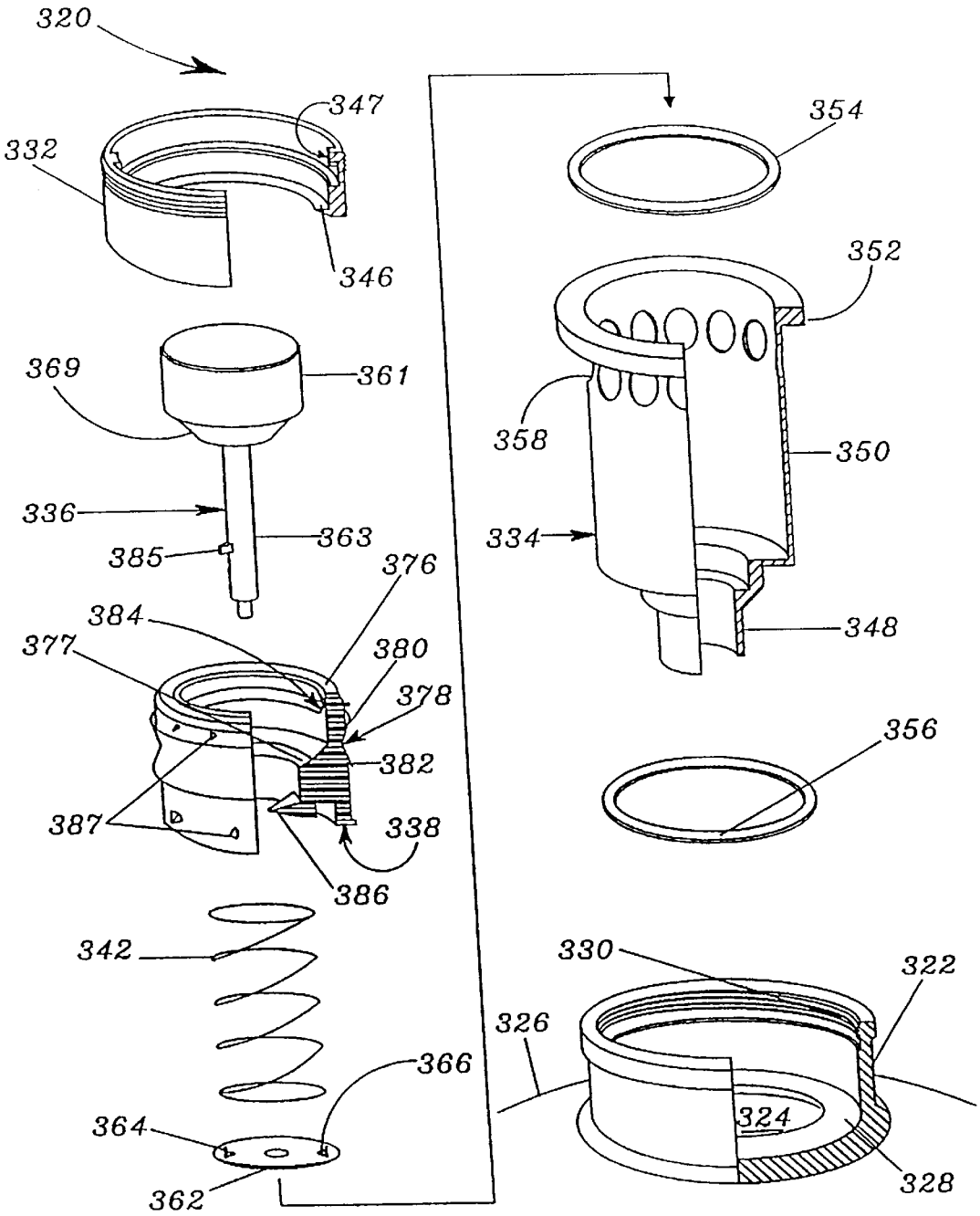
FIG. 12 is an exploded perspective view of the valve assembly of FIGS. 9–11.

When, as illustrated in FIGS. 9 and 11, there is no external coupling attached to valve assembly 320, spring 342 returns the sealing ring 338 to its neutral or closed state, thereby containing liquid and gas within container 326 for transport. In the event of pressure build-up within the container 326 due to the imposition of thermal or mechanical agitation, excess pressure in the container 326 will force the dispensing tower 336 upwardly, against the biasing force of control spring 342, so that the bottom horizontal plane or shoulder 369 of the large diameter or head 361 of the post or dispensing tower 336 moves past the horizontal plane or sealing face 377 of the a sealing ring 338. The pressurized gas in the container 326 is then free to vent through the ingress/egress portals 358 of riser pipe 334, then through the center of the sealing ring 338, past the open egress pathway between the sealing ring 338 and the dispensing tower 336, and out of the valve assembly 320.

5. Description of Fourth Embodiment

Still another embodiment of the invention is illustrated in FIGS. 13–16. The valve assembly 420 constructed in accordance with this fourth embodiment differs from the valve assembly 20 of the first embodiment primarily in that, in a pressure relief or venting mode, the dispensing tower 436 is held stationary and the sealing ring 438 moves upwardly to achieve the desired venting. Several relatively minor structural changes are made to the valve assembly 420 to permit this alternate operation. However, the valve assembly 420 of this embodiment is for the most part similar in construction and operation of the valve assembly 20 of the first embodiment. Components of this embodiment corresponding to components of the first embodiment are, accordingly, designated by the same reference numerals, incremented by 400. Those features which are altered with respect to the first embodiment will now be detailed.

Figure 13:
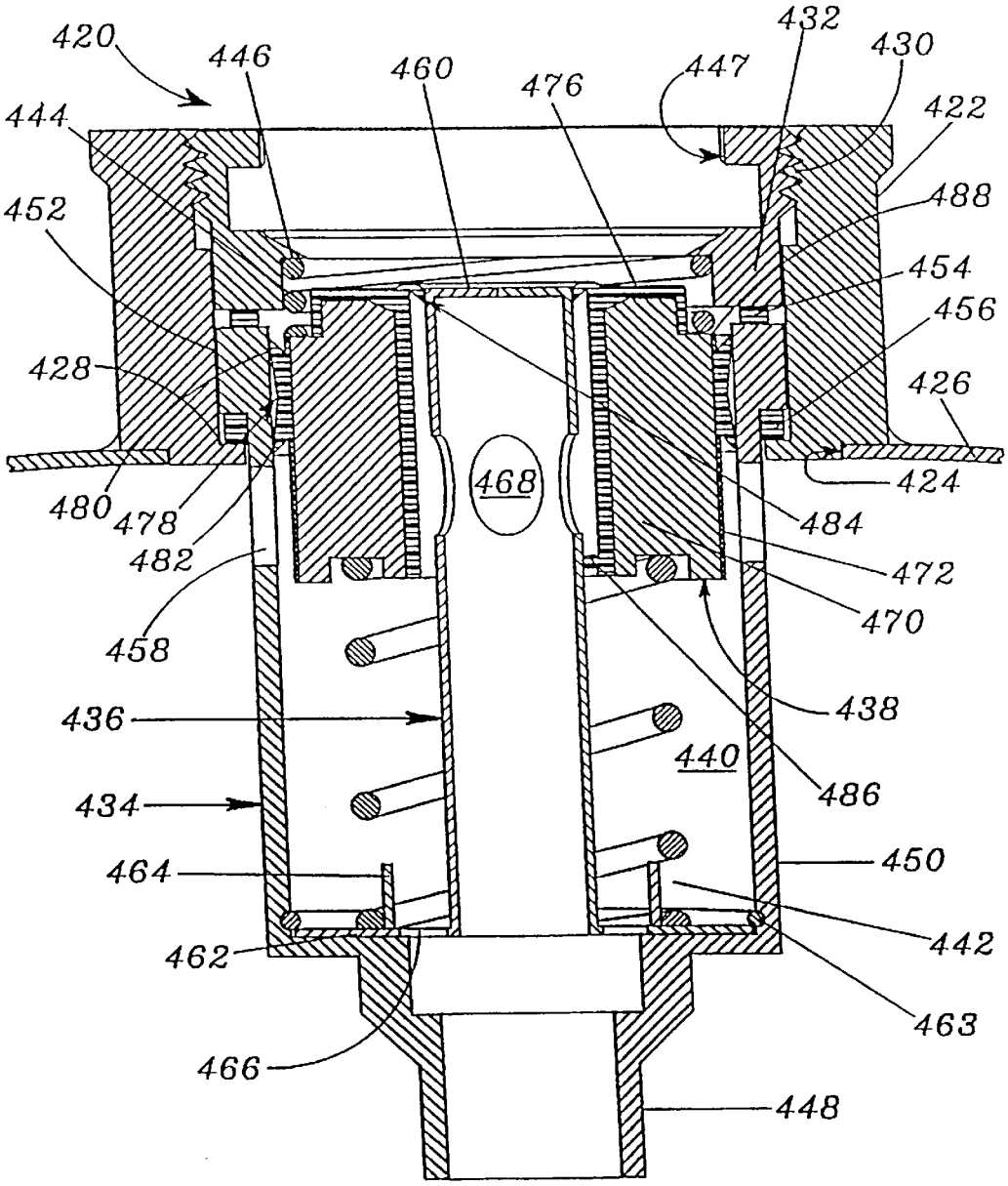
FIG. 13 is a sectional elevation view of a valve assembly according to a fourth embodiment of the invention and showing the valve assembly in its neutral or closed mode.

First, the sealing ring 438 does not engage the ring 446 of the housing 432 when the valve assembly 420 is in its neutral or closed position illustrated in FIG. 13. Rather, the sealing ring 438 is held in a neutral position in which it is spaced between the housing ring 446 and the ingress/egress portals 458 of the riser pipe 434 under the balancing action of the sealing spring 442 and a second, venting spring 444 acting against the sealing spring 442. The venting spring 444 is positioned axially between the housing ring 446 and the sealing ring 438 and is configured to apply a downward biasing force on the sealing ring. Contact between an intermediate axial portion of the sealing ring and the spring 444 is made possible by configuring the sealing ring 438 such that it is somewhat longer than the sealing ring 38 of the first embodiment and such that it has a stepped outer peripheral surface so as to present an upwardly facing shoulder 488 on which the spring 444 rests.

Second, the bottom flange or ring 462 of the dispensing tower 436 is larger in diameter than the flange or ring of the first embodiment and is held in its illustrated position by a retaining ring 463 mounted in the riser pipe 434, and/or protrusions within riser pipe 434.

The operation of the valve assembly 420 constructed in accordance with the fourth embodiment will now be described.

In the neutral or closed position of the valve assembly 420 illustrated in FIG. 13, the outer sealing lip 478 of the sealing ring 438 seals against the riser pipe 434 at a location above ingress/egress portals 458, and the inner sealing lip 484 seals against the dispensing tower 436 at a location above the discharge portals 468. The sealing ring 438 is held in its illustrated neutral position by the opposing forces of the upper venting spring 444 and the lower sealing spring 442. As in the previous embodiments, the ingress/egress portals 458 and discharge portals 468 share the same gas pressure, present throughout chamber 440 due to the flow of gas among the projections 486, thereby allowing the liquid in container 426 to seek its own level away from portals 458, which in turn improves the coupling safety when a coupling arrangement is attached to the valve assembly 420.

Figure 14:
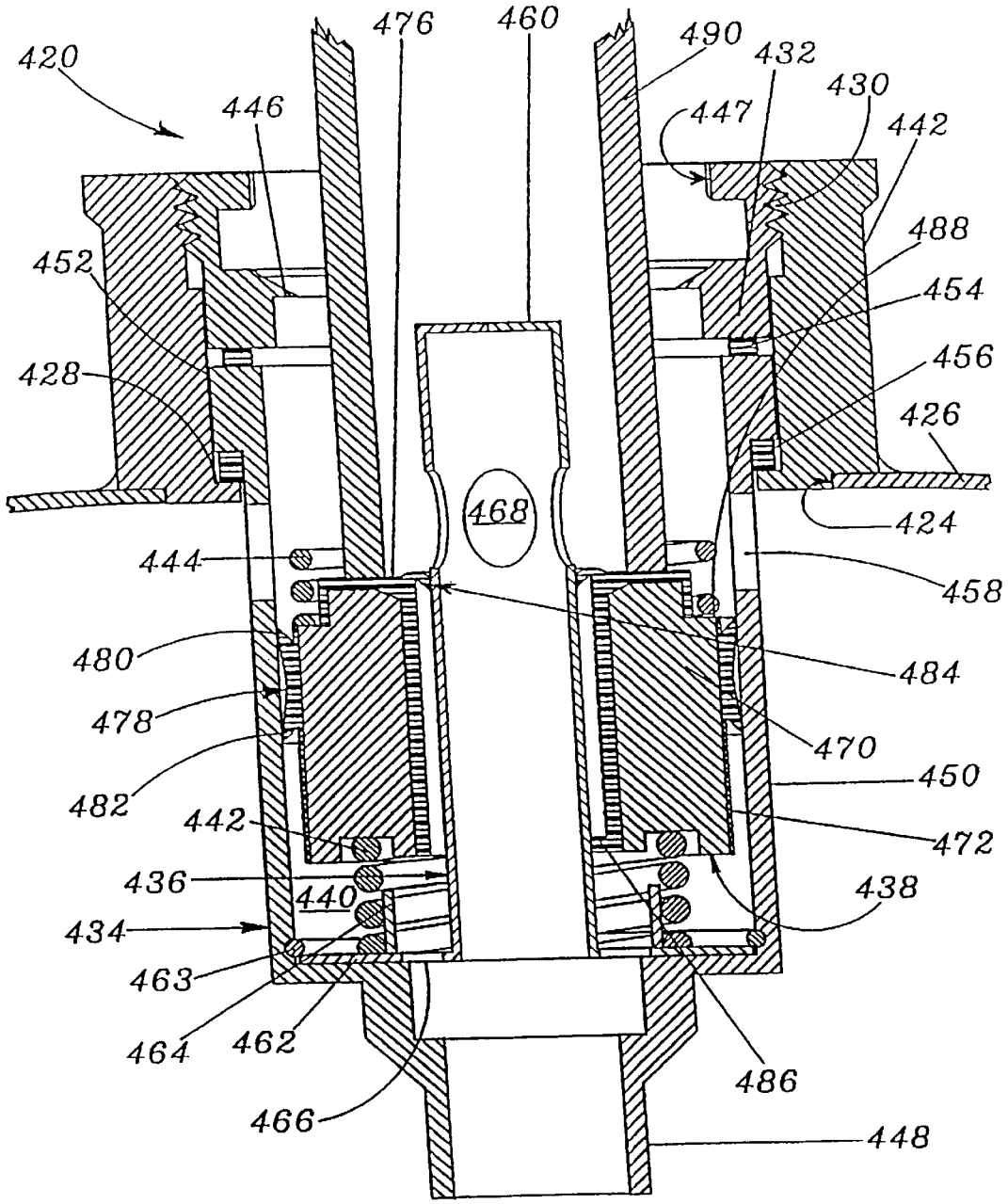
FIG. 14 is a sectional elevation view of the valve assembly of FIG. 13 and showing the valve assembly in its normal or working mode.
Figure 15:
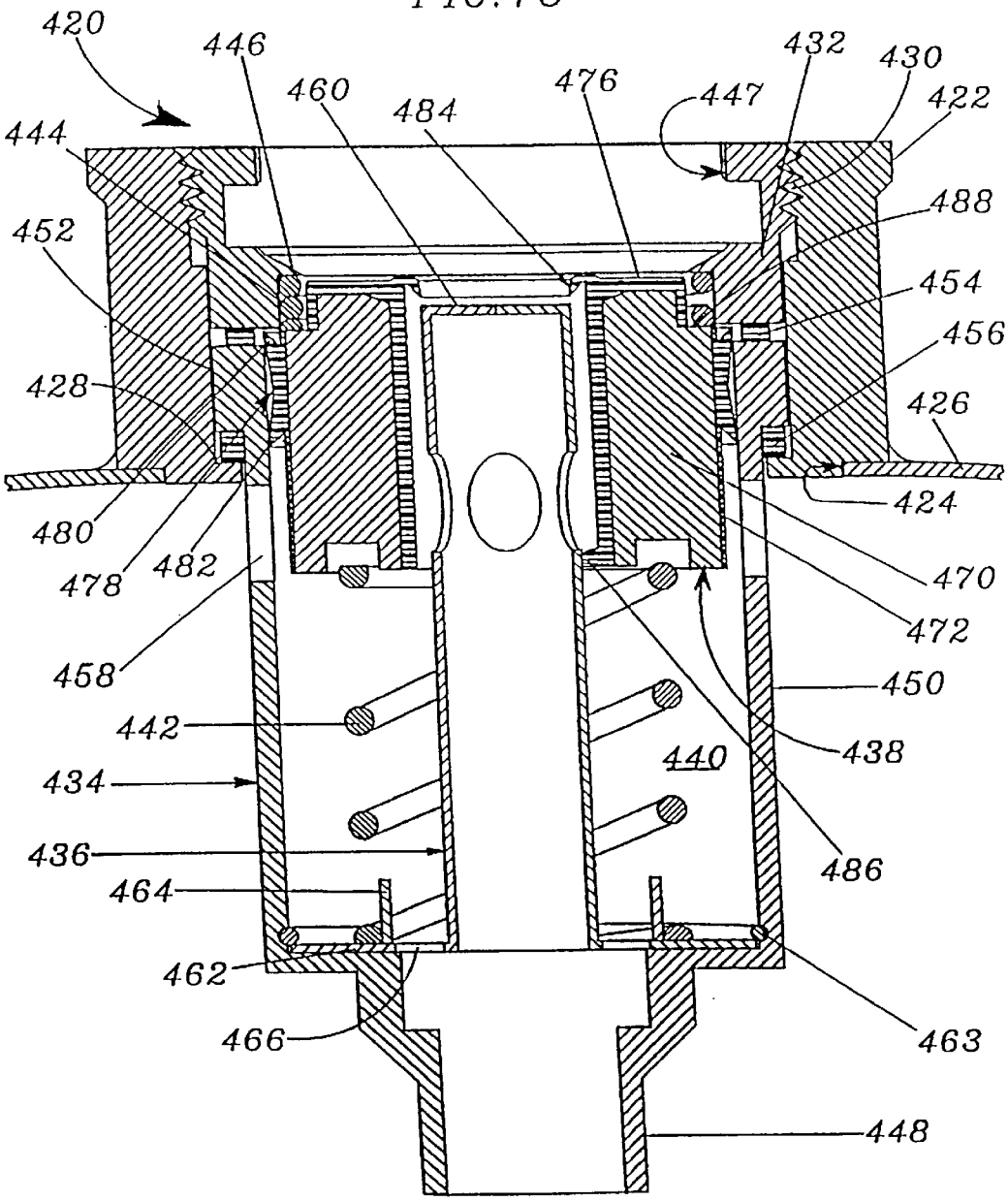
FIG. 15 is a sectional elevation view of the valve assembly of FIGS. 13 and 14 and showing the valve assembly in its pressure release or venting mode.
Figure 16:
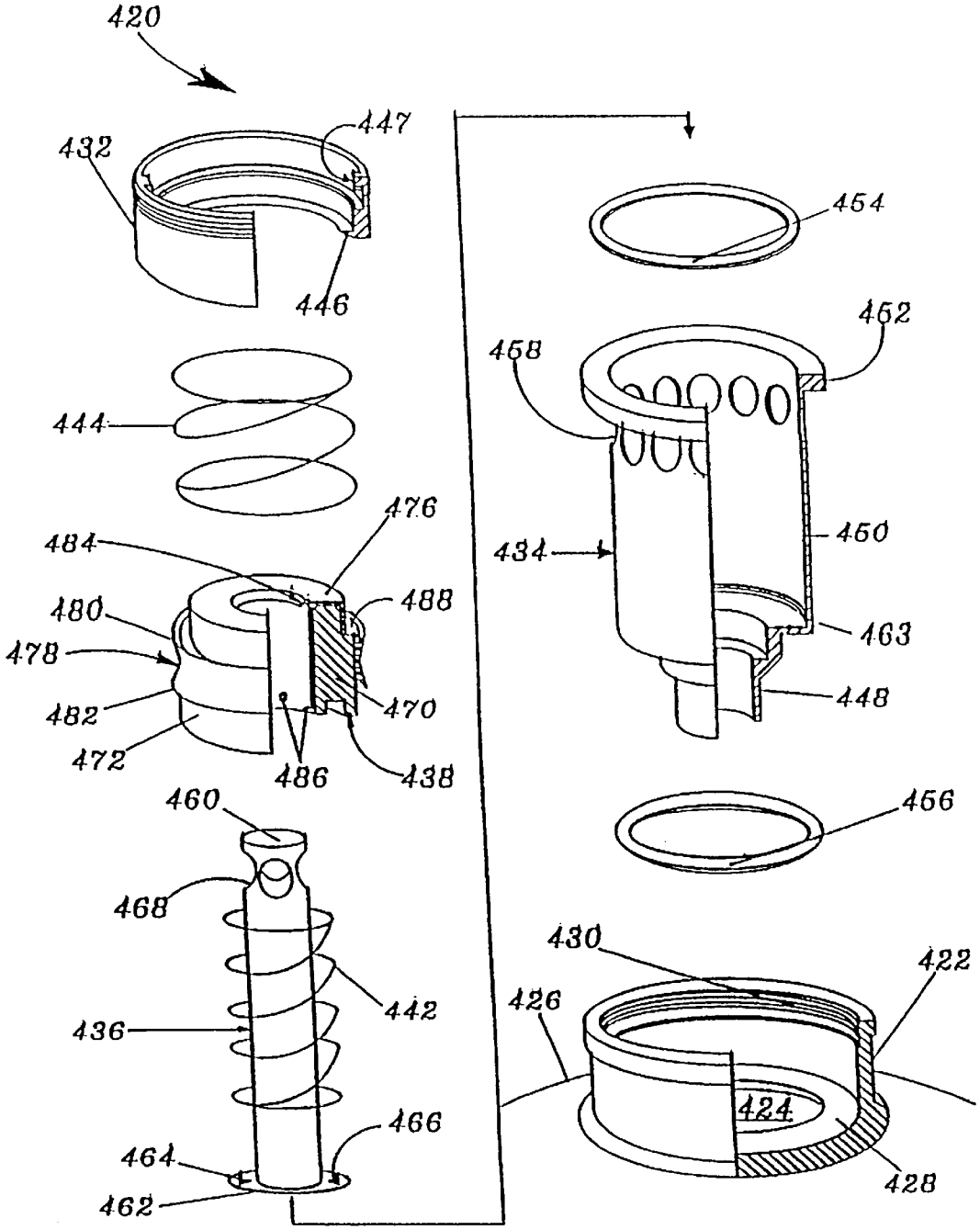
FIG. 16 is an exploded perspective view of the valve assembly of FIGS. 13–15.

Turning now to FIG. 14, the valve assembly 420 is placed in its working mode of operation in which it is open to gas ingress and liquid egress by driving the sealing ring 438 downwardly, against the force of the spring 442, using a spindle 490 of a conventional fixed external coupling arrangement. The spindle 490 comes into contact with the upper sealing face 476 of the sealing ring 438 and forces the sealing ring 438 downwardly from the position illustrated in FIG. 13 to the position illustrated in FIG. 14. As in the previous embodiments, coupling of the spindle 490 to the sealing face 476 creates an ingress tube radially outside of the spindle 490 for flow of the propellant gas into the container 426, and an egress tube within the spindle 490 for the flow liquid out of the container 426. The integrity of the gas and liquid separation at the circular line of contact between the spindle 490 and the sealing face 476 is maintained by the upward pressure of sealing spring 442. Seal integrity is enhanced further by the conical projections 486 and/or vertical ribs (not shown in this embodiment), fixed on the I.D. and/or O.D. walls of the sealing ring 438, in the manner discussed above in connection with the previous embodiments.

When the sealing ring 438 is forced downwardly to the position illustrated in FIG. 14, (1) the ingress/egress portals 458 are exposed to propellent gas flowing into the valve assembly 420 from the region surrounding the spindle 490, and (2) the discharge portals 468 are exposed to the internal fluid discharge passage of the spindle 490. Outer sealing lip 478 prevents the propellant gas from entering the liquid at a location just below the portals 458 of riser pipe 434. Sealing lip 480 therefore preserves ingress propellant pressure integrity as pressurized gas flows into the container 426, and sealing lip 482 also prevents the liquid from entering the portals 458 of riser pipe 434, resulting in the riser pipe 434 being closed off to its gas connection. This in turn forces the gas now entering the container 426 through the portals 458 of riser pipe 434 to push the liquid up the inlet of the riser pipe 434, up through and about the center of dispensing tower 436, enhancing the seal of sealing lip 484 and then out of the dispensing tower through the discharge portals 468. The discharged liquid then flows through the spindle 490 and is dispensed from the system in a conventional manner.

Conversely, when there is no external coupling attached to valve assembly 420, springs 442 and 444 return the sealing ring 438 to its neutral or closed mode as illustrated in FIG. 13, thereby containing liquid and gas within container 426 for transport. If gas pressure within the container 426 increases to excessive levels, the valve assembly 420 assumes the mode illustrated in FIG. 15 in which pent-up gas pressure within the container 426 overcomes the seal between the inner sealing lip 484 of the sealing ring 438 and the dispensing tower 436. That is, gas pressure acting on the sealing ring 438 forces the sealing ring 438 upwardly against the biasing force of the upper spring 444. Since the dispensing tower 436 is held from upward movement by the ring 463 of the riser pipe 434, the inner sealing lip 484 of the sealing ring 438 moves beyond the upper end 460 of the dispensing tower 436 to expose the discharge portals or openings 468 of the dispensing tower to the ambient atmosphere. Excess pressure within the container 426 can then flow past the riser pipe 434, through ingress/egress portals 458, through the dispensing tower 436, and out of the valve assembly 420 through the discharge portals 468.

6. Description of Fifth Embodiment

Still yet another embodiment of the invention is illustrated in FIGS. 17–21. Valve assembly 520 constructed in accordance with this fifth embodiment differs from the valve assembly 320 of the third embodiment primarily in that the dispensing tower 536 is movable downwardly to accommodate the flow of liquid in the normal dispensing mode between sealing ring 538 and the dispensing tower 536. Several structural changes are made to the valve assembly 520 to permit this alternative operation and to achieve other advantages. However, the valve assembly 520 of this embodiment is, for the most part, similar in construction and operation to the valve assembly 320 of the third embodiment. Components of this embodiment corresponding to components of the third embodiment are, accordingly, designated by the same reference numerals, incremented by 200. These components include a valve housing 532, a stationary riser pipe 534, a dispensing tower 536, and a sealing ring 538 which is disposed in an annular chamber 540 formed between the dispensing tower 536 and the riser pipe 534. The valve assembly 520 also includes first and second springs 544 and 542 and an O-ring seal 556. Also as in the previous embodiments, the valve assembly 520 is configured for fitting into a standard stub 522 of a container 526. Those features which are altered with respect to the third embodiment will now be detailed, the remaining features being discussed only to the extend necessary to facilitate an understanding of the operation of the valve assembly 520.

As in the previous embodiments, the riser pipe 534 is mounted on an annular shoulder 528 of the stub 522 and extends into an inlet 524 formed in the container 526. However, the riser pipe 534 differs from the riser pipes of the previous embodiments primarily in that it is tapered inwardly as illustrated so that the lower end of the sealing ring 538 seals against the riser pipe 534 as the sealing ring 536 moves downwardly during valve actuation. Moreover, and as discussed below, the riser pipe 534 is sealed to the valve housing 532 so that the valve housing 532, in effect, forms an extension of the riser pipe.

The dispensing tower 536 differs significantly from the dispensing towers of the previous embodiments.

For instance, rather than being of one-piece construction, it is formed from two parts, namely 1) a plastic body 535 and 2) a metal contact ball 537. The contact ball 537, preferably formed from stainless steel, is inserted into a socket 539 formed in the upper end of the body 535. The ball 537 projects just above the uppermost surface of the body 535 and presents a rigid contact surface for a lower protrusion 592 of a spindle 590 when the spindle 590 is inserted into the valve assembly 520 as detailed below in conjunction with FIG. 18. The ball 537 serves to maintain the circular shape of the uppermost portion of the body 535 and also prevents wear and tear to the dispensing tower 536 which might otherwise occur from coming into contact with the spindle 590.

The body 535 could be formed from any dimensionally stable food-grade material, and preferably is formed from a food-grade plastics materials for cost and weight considerations. An especially preferred material is polysulfone, which is manufactured by Amoco Corp. Polysulfone is preferred because it is rigid, durable, and easy to fabricate. The material also has very closed cell surfaces which inhibit contamination and which make the material ideally suited for use in food processing equipment. In addition, the material is capable of withstanding temperatures from −150 degrees Fahrenheit to +300 degrees Fahrenheit. The body 535 includes an upper annular shoulder 561 which is biased into sealing engagement with the sealing ring 538 via the spring 542. Spring 542 abuts an intermediate radial shoulder 533 on the body 535 at its upper end and abuts an internal flange 531 of the riser pipe 534 at its lower end. A portion of the body 535, extending from the ball 537 to the intermediate shoulder 533, is in the shape of a circular hourglass and conic so that both ends of this portion are wider than a center of this portion.

Figure 21:
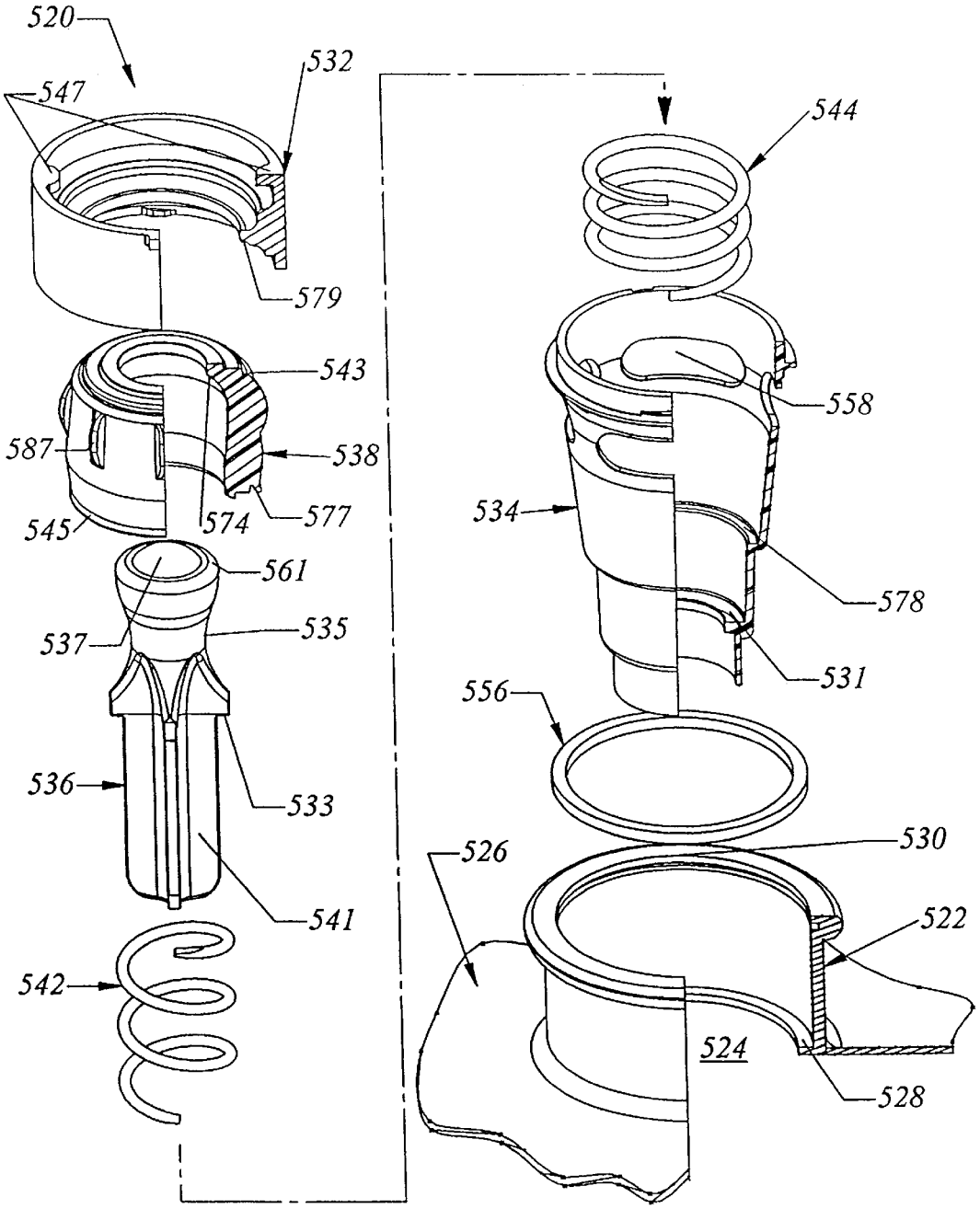
FIG. 21 is an exploded perspective view of the valve assembly of FIGS. 17–20.

In addition, and unlike in the previous embodiments in which the dispensing tower is incapable of downward movement from its neutral position, the dispensing tower 536 is slidable downwardly independently of the sealing ring 538. The dispensing tower 536 of this embodiment also upwardly moves relative to the sealing ring 538 in the pressure relief mode. Measures therefore are preferably incorporated into the design of the dispensing tower 536 to permit fluid flow between the dispensing tower 536 and the sealing ring 538 during pressure relief. Towards these ends, the body 535 of the dispensing tower 536 is formed with one or more external channels or grooves 541 in the surface thereof that extend at least generally axially from the bottom of the dispensing tower 536 to just above the shoulder 533. In the illustrated embodiment, and as best seen in FIG. 21, several channels 541 are formed by forming the lower portion of the body 535 with a fluted or generally cross-shaped cross section to form four such channels 541 around the periphery of the lower portion of dispensing tower 536. However, a lesser or greater number of channels could be formed to accommodate more or less flow, for example.

Figure 17:
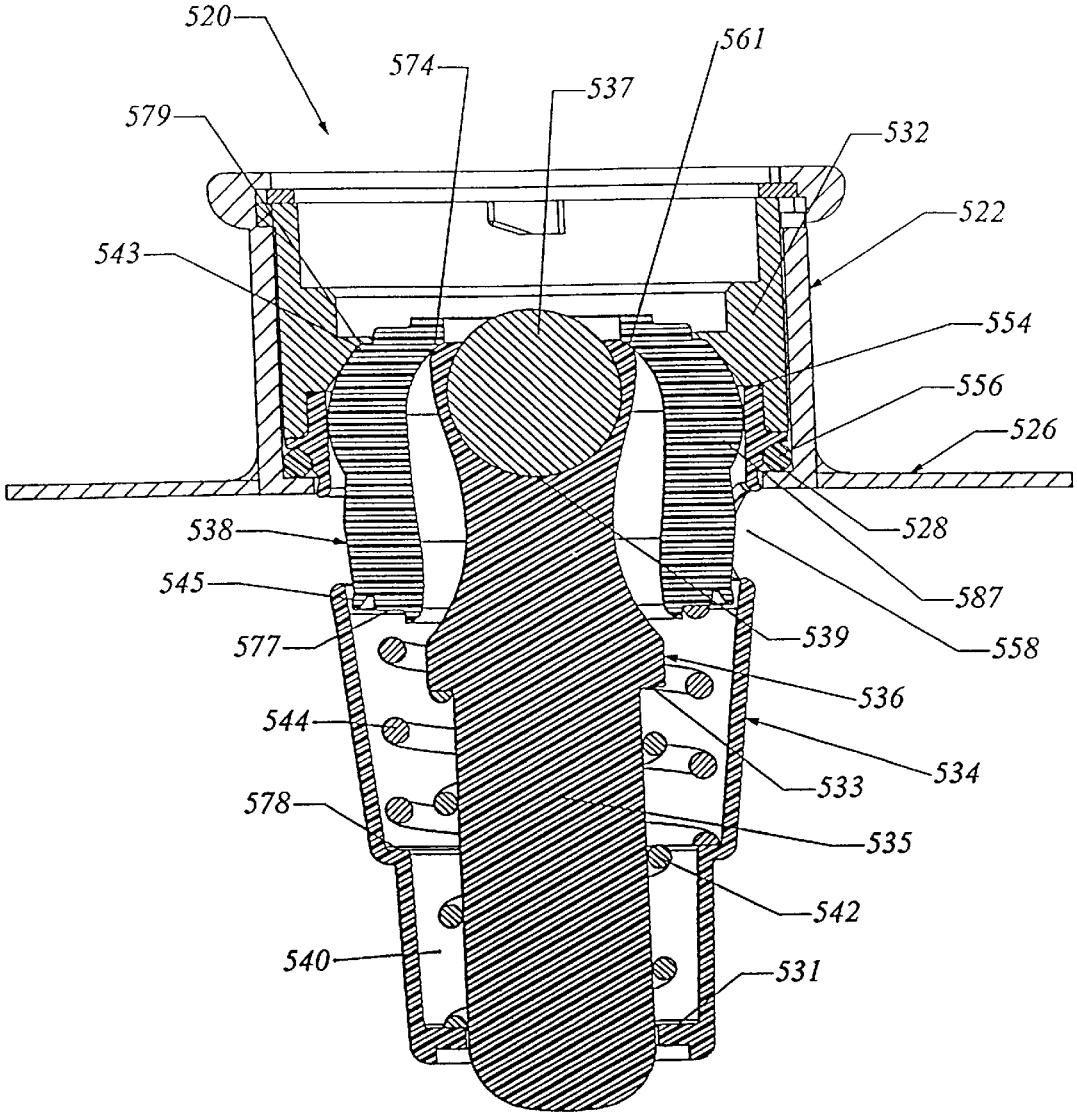
FIG. 17 is a sectional elevation view of a valve assembly according to a fifth embodiment of the invention and showing the valve assembly in its neutral or closed position.

The sealing ring 538, and particularly the outer periphery thereof, could be identical in construction and operation to the sealing ring 338 of the third embodiment. However, the illustrated and currently-preferred sealing ring 538 differs from the sealing rings of the first and third embodiments primarily in that 1) it lacks the pronounced sealing lips and 2) it seals against the valve housing 532 rather than the riser pipe 534 when it is in its neutral or closed position. The sealing ring 538 also curves inwardly at its upper end to form a lip-like structure (hereafter known simply as a "lip" 574). As best seen in FIG. 17, lip 574 acts as a stop against which the shoulder of the dispensing tower 536 seals when the valve assembly 520 assumes its neutral or closed position. The lip 574, and preferably the entire sealing ring 538, is made of a resilient material such as neoprene or EPDM, or other resilient material suitable for use in connection with food or beverage containers.

The functions of the outer sealing lip of the previous embodiments are performed in this embodiment by upper and lower sealing members 543 and 545 which sequentially seal at locations above and below the ingress/egress portals 558 as the sealing ring 538 moves downwardly in the chamber 540. The upper sealing member 543 comprises a stepped shoulder which engages a stepped groove 579 in valve housing 532 when the valve assembly 520 assumes its neutral or closed position. Stepped groove 579 presents a double seal so that at least two surfaces of the upper sealing member 543 are sealingly engaged when the valve is closed. Stepped groove 579 also serves as a stop that retains the sealing ring 538 in the valve assembly 520. The sealing ring 538 is biased into engagement with the stepped groove 579 by the spring 544, which rests in a spring groove 577 in the base of the sealing ring 538 at its upper end and on an intermediate radial flange 578 of the riser pipe 534 at its lower end. The lower sealing member 545 takes the form of an outer peripheral surface of the lower portion of the sealing ring 538 which sealingly engages the tapered riser pipe 534 as the sealing ring 538 moves downwardly within the chamber.

In addition, and as in the previous embodiments, a plurality of centering projections are provided on the I.D and/or the O.D. of the sealing ring 538 to guide and stabilize the sealing ring 538 with respect to the member they contact while maintaining the eccentricity of these elements and permitting the free-flow of fluid past the projections. In the illustrated embodiment, centering projections 587 are formed integrally with the remainder of the sealing ring 538 and abut the riser pipe 534 so as to guide and stabilize the sealing ring 538 with respect to the riser pipe 534. The projections 587 may be either arcuate as illustrated, frusto-conical as in the previous embodiments, or any other desired shape. Projections may, if desired, be provided on the I.D. of the sealing ring 538 instead of or in addition to the projections 587 in order to guide and stabilize the sealing ring 538 relative to the dispensing tower 536.

An additional feature of the fifth embodiment is the substitution of a layer 554 of structural two-part adhesive for the sealing ring or gasket of the preferred embodiment such as the sealing rings 54 and 354 of the first and third embodiments. Adhesive layer 554 provides the same sealing capability of the sealing rings and also adds additional structural integrity to the joint, thereby unifying valve housing 532 and the riser pipe 534 into a single riser pipe.

In the neutral or closed mode, best seen in FIG. 17, dispensing tower 536 is sealingly urged against sealing ring 538 by the second spring 542, and the upper seal 543 of the sealing ring 538 is sealingly urged against the annular groove 579 by both springs 544 and 542. As a result, and as in the previous embodiments, the ingress/egress portals 558 and chamber 540 share the same pressure, thereby allowing the liquid in container 526 to seek its own level away from portals 558 via the inlet of the riser pipe 534. This in turn improves the coupling safety when a coupling arrangement is attached to the valve assembly 520.

Figure 18:
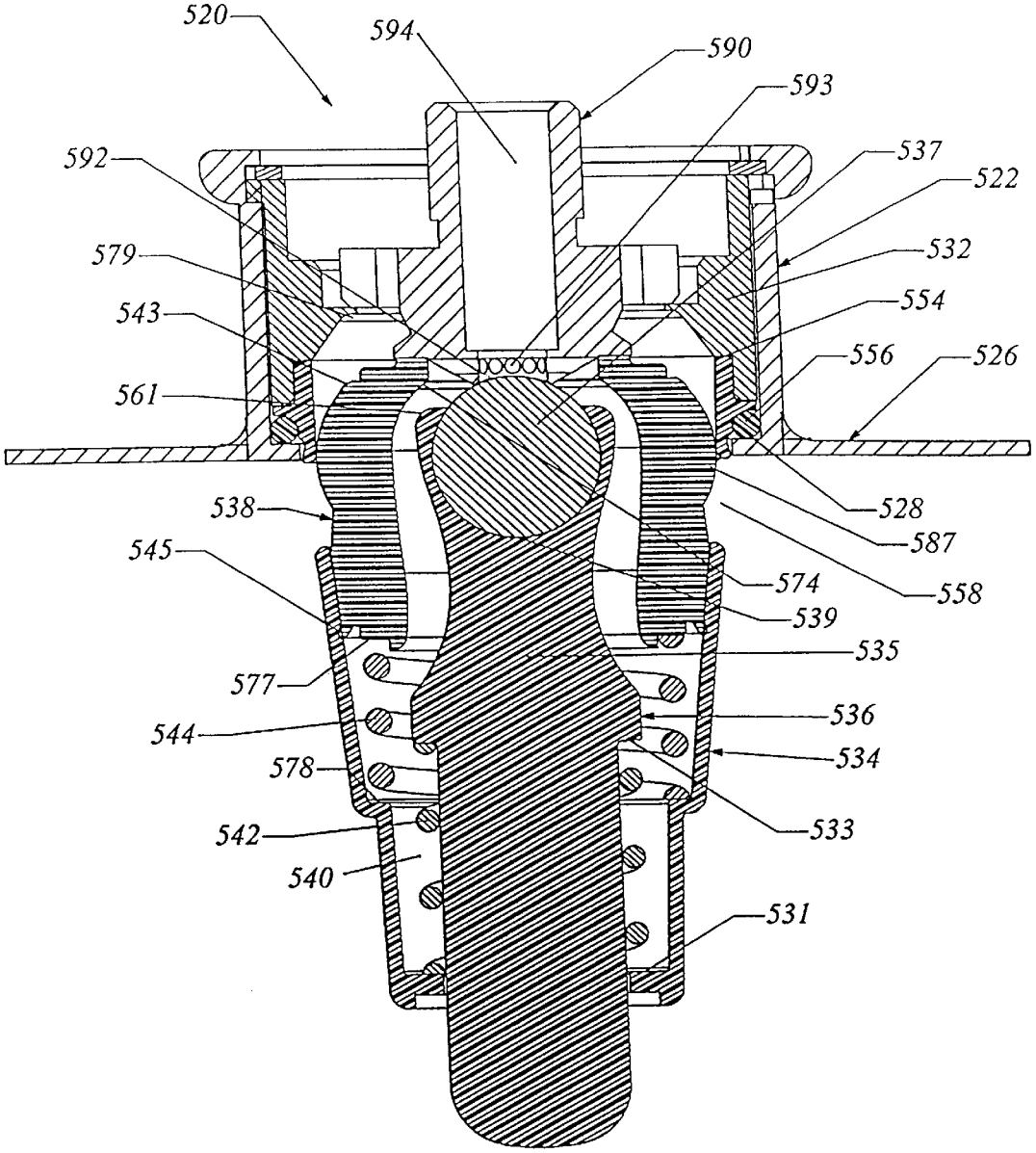
FIG. 18 is a sectional elevation view of the valve assembly of FIG. 17 showing the valve assembly in its normal or working mode.

As best shown in FIG. 18, when a spindle 590 is inserted into the bore of the valve assembly 520 and turned on its axis, it engages a pair of lugs 547 (FIG. 21) in bayonet-like fashion in a manner which is, per se, well known. Alternatively, the spindle 590 may be threaded into the bore of the valve assembly 520. The spindle 590 illustrated in FIG. 18 has been custom modified from the standard spindle in order to present a cylindrical radially centered axial projection 592 on the end of spindle 590. Projection 592 serves to drive the dispensing tower 536 downwardly against the force of second spring 542 to create a valve opening between dispensing tower 536 and the lip 574 of sealing ring 538 so as to permit the passage of liquid through the valve opening, through a number of radial holes 593 in the projection 592, and up into the liquid channel 594 of spindle 590.

The spindle 590 also contacts sealing ring 538 as it moves downwardly and forces sealing ring 538 downwardly to expose portals 558 to incoming gas. In addition, downward movement of sealing ring 538 also causes the lower sealing member 545 of sealing ring 538 to snugly seal against the tapered stationary riser 534 at a location beneath ingress/egress portals 558. Gas/liquid separation therefore is maintained in the same manner as in the previous embodiments. Gas can now enter the container 526 through the portals 558 of riser pipe 534 to push the liquid up the inlet of the riser pipe 534, between the dispensing tower 536 and the sealing ring 538, and into the spindle 590, where the fluid is dispensed from the system in a conventional manner.

Figure 19:
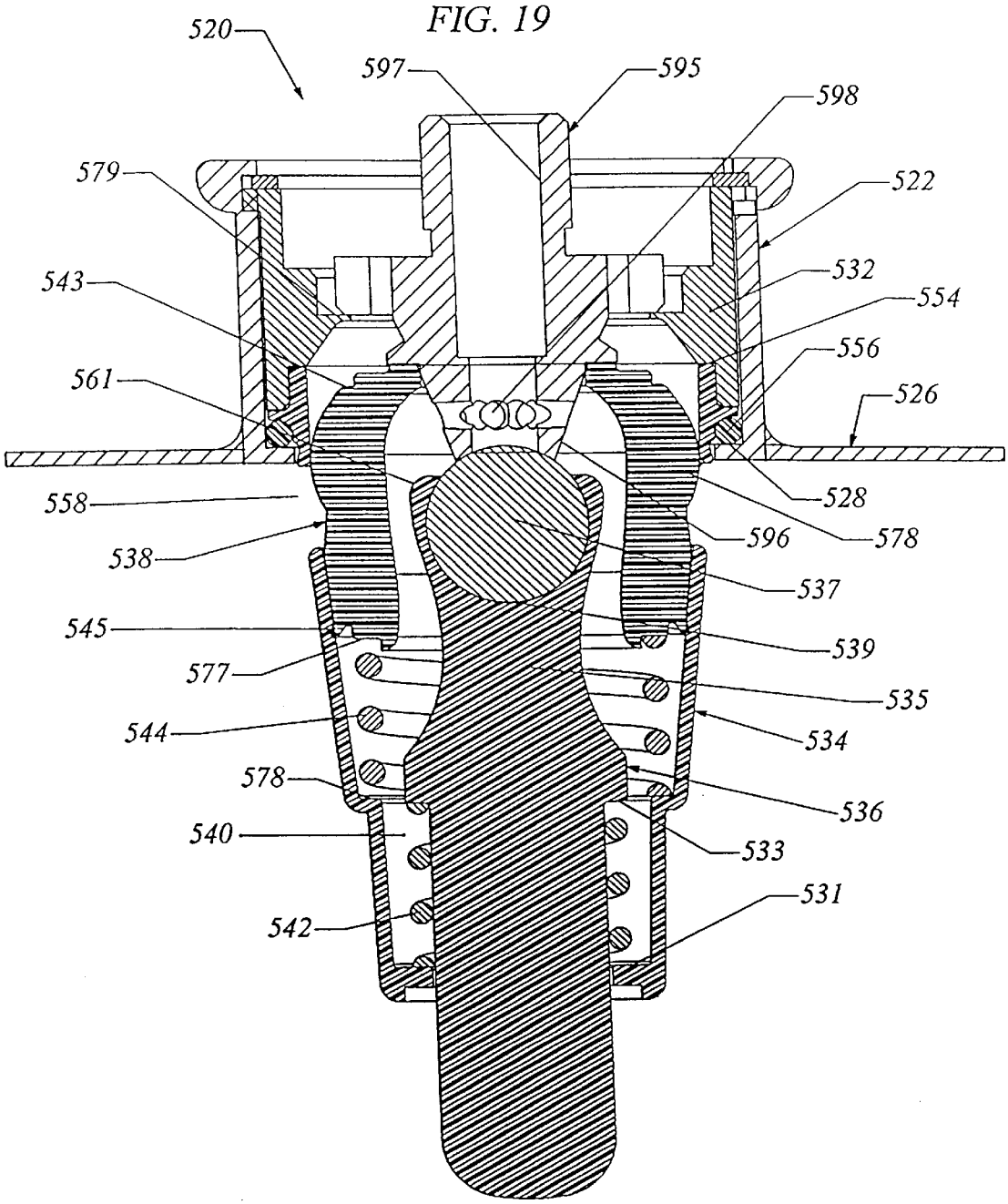
FIG. 19 is a sectional elevation view of the valve assembly of FIGS. 17 and 18 and showing the valve assembly in a wash/fill mode thereof.

Referring now to FIG. 19, the valve assembly 520 is illustrated in a wash/fill mode of operation. In order to accommodate rapid washing and filling of container 526, dispensing tower 536 is capable of even further downward movement than the movement required for the normal dispensing mode. A wash/fill fitting 595 is inserted into the bore of the valve assembly 526 and has a wash/fill protrusion 596 extending downwardly therefrom to displace the dispensing tower 536 downwardly. This protrusion is longer than the projection 592 of the dispensing spindle 590 so as to effect greater relative movement between the dispensing tower 536 and the sealing ring 538. This movement is sufficient to force the shoulder 561 of the dispensing tower 536 to a position far enough beneath the lip 574 of the sealing ring 538 to maximize the area of the annular opening between the dispensing tower 536 and the sealing ring 538. This large opening accommodates the rapid flow of liquid into container 526 from an internal passage 597 and discharge holes 598 of the wash/fill fitting 595 to facilitate washing and filling of the container 526 and valve assembly 520. At the same time, the wash/fill fitting 595 displaces sealing ring 538 downwardly to open portals 558 and to also sealingly engage the I.D. of riser pipe 534 just below portals 558. In this way, as liquid is forced downwardly into the valve assembly 520 in the wash/fill mode, ingress or egress of gas is permitted through portals 558. Conversely, gas may be forced back into the container 526 through portals 558 to accomplish rapid evacuation of the container 526.

Figure 20:
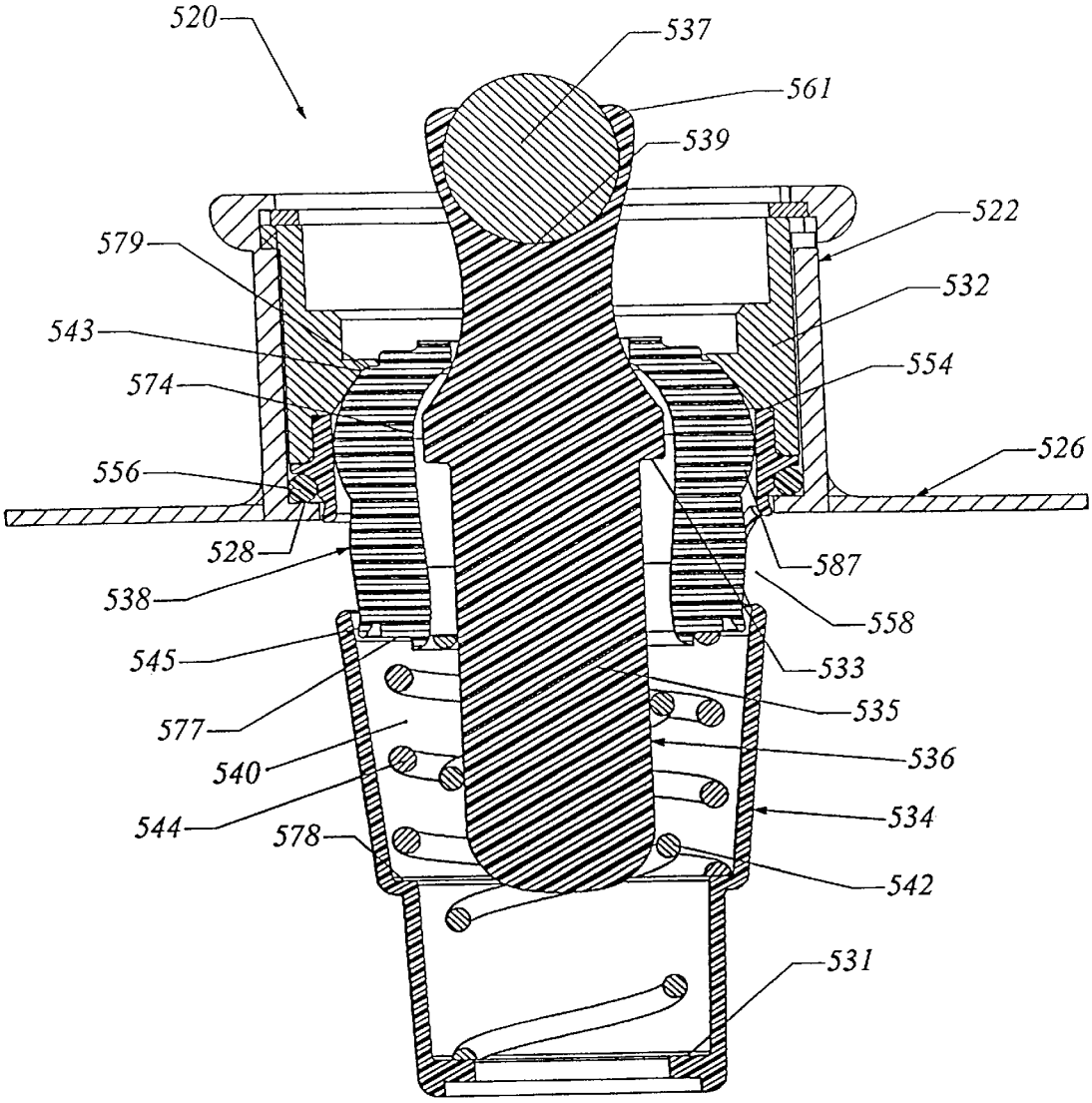
FIG. 20 is a sectional elevation view of the valve assembly according to FIGS. 17–19 and showing the valve assembly in its pressure release or venting mode.

The pressure relief mode is illustrated in FIG. 20. In previous embodiments, the pressure relief function of the valve assembly is regulated by the tension of the spring 44. In this embodiment, as pressure builds on dispensing tower 536, from below, forces generated by this pressure are opposed by the retaining forces imposed on the dispensing tower 536 by the lip 574. Since sealing ring 538 is made from a resilient material such as EPDM or neoprene, the lip 574 deforms to permit the dispensing tower 536 to move or "pop" up through the sealing ring 538 when the gas pressure from within the container 526 reaches a sufficient magnitude. This movement exposes the upper openings of channels 541 of the dispensing tower 536 to the atmosphere and permits fluid to flow up through the channels 541 and out of the bore of the valve assembly 520. The upper portion of intermediate radial shoulder 533 on the body 535 prevents the dispensing tower 536 from completely exiting the valve assembly 520 during this process. After excess pressure has been released from the container 526, it is necessary to "reset" the valve assembly 520 by manually or is mechanically forcing the dispensing tower 536 back to its neutral position beneath the lip 574 of the sealing ring 538.

7. Advantages

The valve assembly according to the preferred embodiments of the present invention, having the above-mentioned construction, exhibits several benefits. It can be retrofitted to millions of existing containers while at the same time using less parts within the same space than previously-known valve assemblies. The inventive valve assembly therefore exhibits greater cross-sectional ingress and egress areas than previously-known valve assemblies, thereby improving fill rates and reducing costs to the users. It also can control the internal pressure of a container and is adjustable by simply changing the biasing force imposed by springs and/or components of the valve assembly. The valve assembly is bi-directional and is able to use the same portals for both gas and liquid. In addition, it is able to share the same chamber with a gas and a liquid, keeping them separated when working, yet together when at rest, so as not to allow liquid to be present at coupling transition points. The sealing ring of the valve assembly may be formed from a single molded polymer member that does not have to be rigidified if design need not require so. The valve assembly also is sequentially timeable with regards to the fixed portal locations of the valve housing and the fixed sealing lip locations on the moving molded polymer sealing ring, thereby allowing the valve to mix more then one liquid or gas in the same chamber, with the differential between them being controllable by design. The sealing ring of the valve assembly also can maintain perpendicularity and eccentricity with the use of a plurality of conical projections and/or vertical ribs fixed to its I.D. and/or O.D or even the mating dispensing tower as illustrated in FIGS. 9–12 and 17–21. The valve assembly also can control pressure on either side of a single movable molded polymer sealing ring. In addition, the sealing ring can be used in combination with various types of reciprocating members, e.g. hydraulic piston valve, even though a container valve is its present conveyance and benefactor.

Although the invention has been described through its specific forms, it is to be understood that various changes and modifications may be imparted thereto without departing from the scope of the invention.

I claim:

1. A valve assembly for selectively permitting a liquid to be dispensed from a container under gas pressure within said container, said valve assembly comprising:

(A) a valve seat;

(B) a riser pipe configured for mounting in an opening of said container, said riser pipe having 1) an internal surface, 2) a first end located remote from said opening, and 3) a second end located adjacent to said opening;

(C) a dispensing tower, said dispensing tower being positioned radially within said riser pipe and extending at least generally in parallel with said riser pipe, a chamber being formed between said internal surface of said riser pipe and said dispensing tower; and (D) a sealing ring which is positioned within said chamber and which has an internal surface and an external surface; wherein said sealing ring is slidable within said chamber 1) from a first position in which said external surface of said sealing ring seals against said valve seat to prevent gas flow through said valve assembly 2) to a second position in which said external surface of said sealing ring is withdrawn from sealing engagement with said valve seat to permit gas flow through said valve assembly, and wherein said dispensing tower is slidable independently of said sealing ring 1) from a first position in which said dispensing tower seals against said internal surface of said sealing ring to prevent liquid flow therebetween 2) to a second position in which said dispensing tower is withdrawn from sealing engagement from said internal surface of said sealing ring to permit liquid flow therebetween.

2. The valve assembly as defined in claim 1, further comprising an ingress/egress portal positioned between said first and second ends of said riser pipe, said ingress/egress portal being isolated from an exterior of said valve assembly when said sealing ring is in said first position and being in fluid communication with the exterior of said valve assembly when said sealing ring is in said second position.

3. The valve assembly as defined in claim 2, wherein said ingress/egress portal is sealed from fluid communication with said first end of said riser pipe when said sealing ring is in said second position.

4. The valve assembly as defined in claim 1, wherein said dispensing tower includes an upper portion and a lower portion, wherein and said lower portion comprises at least one channel that permits fluid to flow at least generally axially along the length of said lower portion of said dispensing tower.

5. The valve assembly as defined in claim 1, wherein said sealing ring comprises a compressible material that permits at least a portion of said dispensing tower to pass through said sealing ring when a predetermined pressure within said container has been exceeded so that said valve assembly acts as a pressure relief valve.

6. The valve assembly as defined in claim 5, wherein said compressible material is also resilient.

7. The valve assembly as defined in claim 6, wherein said compressible material comprises EPDM.

8. The valve assembly as defined in claim 5, wherein a lip extends around the inner radial periphery of an upper portion of said sealing ring.

9. The valve assembly as defined in claim 1, wherein said dispensing tower includes a metal ball forming an upper contact surface thereof.

10. The valve assembly as defined in claim 1, wherein at least part of said dispensing tower is formed from polysulfone.

11. The valve assembly as defined in claim 1, further comprising a spring which biases said dispensing tower towards said first position.

12. The valve assembly as defined in claim 1, further comprising a spring which biases said sealing ring towards said first position.

13. A valve assembly for selectively permitting a liquid to be dispensed from a container under gas pressure within said container, said valve assembly comprising:

(A) a riser pipe configured for mounting in an opening in said container, said riser pipe having 1) an internal surface, 2) a first end located remote from said opening, and 3) a second end located adjacent said opening, an ingress/egress portal being formed in said riser pipe between said first and second ends thereof;

(B) a dispensing tower positioned radially within said riser pipe, said dispensing tower having an external surface and extending at least generally in parallel with said riser pipe, a chamber being formed between said external surface of said dispensing tower and said internal surface of said riser pipe; and (C) a sealing ring which is positioned within said chamber radially between said dispensing tower and said riser pipe; wherein at least one of said sealing ring and said dispensing tower is movable within said chamber (1) from a first position in which said sealing ring seals against a surface of said valve assembly at a location on one side of said ingress/egress portal so as to prevent gas flow through said ingress/egress portal and out of said valve assembly, and in which said sealing ring seals against said external surface of said dispensing tower and prevents liquid from flowing out of said valve assembly, and (2) to a second position in which said sealing ring seals against said internal surface of said riser pipe at a location on another side of said ingress/egress portal and in which said sealing ring and said dispensing tower are positioned relative to one another so as to permit liquid to flow past said sealing ring and out of said valve assembly.

14. A valve assembly as defined in claim 13, wherein, during movement from said first position to said second position, said sealing ring moves relative to said riser pipe and said dispensing tower remains stationary relative to said riser pipe.

15. A valve assembly as defined in claim 13, wherein, during movement from said first position to said second position, said sealing ring and said dispensing tower both move relative to said riser pipe and to one another.

16. A valve assembly as defined in claim 13, wherein, wherein when the at least element is in said first position, said sealing ring seals against said another side of said ingress/egress portal.

17. A valve assembly for controlling the flow of a liquid from a container, said container having an opening formed therein, said valve assembly comprising:

(A) a riser pipe having first and second ends, an ingress/egress portal being positioned between said first and second ends of said riser pipe;

(B) a dispensing tower, said dispensing tower being positioned radially within said riser pipe and extending at least generally in parallel with said riser pipe, a chamber being formed between said internal surface of said riser pipe and said dispensing tower;

(C) a sealing ring which is positioned within said chamber radially between said dispensing tower and said riser pipe; and (D) means for mechanically driving at least said sealing ring to move within said chamber (1) from a first position preventing gas or liquid flow out of said container, and (2) to a second position in which gas flows through said ingress/egress portal from above said sealing ring and liquid flows past said sealing ring from below and out of said container, wherein at least one of said dispensing tower, said sealing ring, and said riser pipe is dimensioned and configured such that, as said sealing ring moves from said first position thereof to said second position thereof, said sealing ring isolates said ingress/egress portal from pressurized liquid in said riser pipe.

18. A valve assembly as defined in claim 17, wherein said means for mechanically driving also drives said dispensing tower to move within said chamber.

19. A method of selectively controlling the flow of liquid from a container, said container having an opening formed therein in which is inserted a riser pipe and a dispensing tower, an annular chamber being formed between said riser pipe and said dispensing tower, an ingress/egress portal being formed in said riser pipe, said method comprising:

(A) mechanically driving a sealing ring to move downwardly within said chamber (1) from a first position preventing gas flow out of said container, and (2) to a second position in which gas flows through said ingress/egress portal from above said sealing ring; and (B) mechanically driving said dispensing tower to move downwardly within said chamber, independently of said sealing ring, (1) from a first position preventing liquid flow out of said container, and (2) to a second position in which liquid flows past said sealing ring from below and out of said container.

20. A method as defined in claim 19, further comprising driving said sealing ring and said dispensing tower downwardly to respective wash/fill positions in which 1) said ingress/egress portal is exposed to the exterior of said container and 2) the diameter of a gap between said sealing ring and said dispensing tower is at least essentially maximized, and then while said sealing ring and said dispensing tower are in said wash/fill positions, washing and then filling said container.

21. A method as defined in claim 19, further comprising returning said dispensing tower and said sealing ring to the first positions thereof, and then generating a gas pressure of above a designated magnitude within said container to force said dispensing tower to move axially relative to said riser pipe and said dispensing tower such that (1) an upper end of said dispensing tower is disposed above an upper surface of said sealing ring to open at least one passage between said dispensing tower and said sealing ring, and such that (2) fluid is free to flow through said passage and out of said container, thereby relieving said gas pressure.

22. A method of selectively controlling the flow of liquid from a container, said container having an opening formed therein in which is inserted a riser pipe, a dispensing tower, and a seal arrangement disposed radially between said dispensing tower and said riser pipe, an annular chamber being formed between said riser pipe and said dispensing tower, and an ingress/egress portal being formed in said riser pipe, said method comprising:

mechanically driving at least said seal arrangement to move downwardly (1) from a first position preventing gas flow out of said container and preventing liquid flow out of said container, and (2) to a second position in which said seal arrangement seals against an internal surface of said riser pipe at a location beneath said ingress/egress portal, in which gas flows through said ingress/egress portal from above said seal arrangement, and in which liquid flows past said seal arrangement from below and out of said container.

23. A method as defined in claim 22, wherein said seal arrangement comprises a sealing ring.

24. A method as defined in claim 22, wherein, during a portion of the mechanically driving step, both said seal arrangement and said dispensing tower move downwardly.

25. A method as defined in claim 22, wherein, during a portion of the mechanically driving step, only one of said seal arrangement and said dispensing tower moves downwardly.

26. A valve assembly for selectively permitting a liquid to be dispensed from a container under gas pressure within said container, said valve assembly comprising:

(A) a riser pipe configured for mounting in an opening in said container, said riser pipe having 1) an internal surface, 2) a first end located remote from said opening, and 3) a second end located adjacent said opening, an ingress/egress portal being formed in said riser pipe between said first and second ends thereof, (B) a dispensing tower positioned radially within said riser pipe, said dispensing tower having an external surface and extending at least generally in parallel with said riser pipe, a chamber being formed between said external surface of said dispensing tower and said internal surface of said riser pipe; and (C) a seal arrangement which is positioned within said chamber radially between said dispensing tower and said riser pipe; wherein at least one of said seal arrangement and said dispensing tower is movable within said chamber (1) from a first position in which said seal arrangement seals against a surface of said valve assembly at a location on one side of said ingress/egress portal so as to prevent gas flow through said ingress/egress portal and out of said valve assembly, and in which said seal arrangement seals against said external surface of said dispensing tower and prevents liquid from flowing out of said valve assembly, and (2) to a second position in which said seal arrangement seals against said internal surface of said riser pipe at a location on another side of said ingress/egress portal and in which said sealing arrangement and said dispensing tower are positioned relative to one another so as to permit liquid to flow past said seal arrangement and out of said valve assembly.

27. A valve assembly as defined in claim 26, wherein said seal arrangement comprises a sealing ring.

28. A valve assembly as defined in claim 26, wherein, wherein when the at least element is in said first position, said sealing ring seals against said another side of said ingress/egress portal.

* * * * *